US008786580B2

(12) United States Patent
Ooga

(10) Patent No.: US 8,786,580 B2
(45) Date of Patent: Jul. 22, 2014

(54) IMAGE DISPLAY DEVICE AND TRANSMISSION SIGNAL CONTROL METHOD TO BE USED IN SAME

(75) Inventor: Kouichi Ooga, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 256 days.

(21) Appl. No.: 13/233,222

(22) Filed: Sep. 15, 2011

(65) Prior Publication Data

US 2012/0068977 A1 Mar. 22, 2012

(30) Foreign Application Priority Data

Sep. 16, 2010 (JP) ..... 2010-208635
May 10, 2011 (JP) ..... 2011-105735

(51) Int. Cl.
*G09G 5/00* (2006.01)

(52) U.S. Cl.
USPC ..... 345/204; 345/87

(58) Field of Classification Search
None
See application file for complete search history.

(56) References Cited

U.S. PATENT DOCUMENTS 6,249,270 B1 * 6/2001 Ito ..... 345/100
RE42,993 E * 12/2011 Nitta et al. ..... 345/98
2010/0188352 A1 * 7/2010 Ikeda ..... 345/173

FOREIGN PATENT DOCUMENTS

JP 2001-166740 A 6/2001

* cited by examiner

*Primary Examiner* — Jason Olson
(74) *Attorney, Agent, or Firm* — Sughrue Mion, PLLC

(57) ABSTRACT

An image display device and a transmission signal control method to be used in same and more particularly to the image display device and the transmission signal control method that can be suitably used when transmission wirings for data signal based on a video signal become complicated due to configurations of a large-sized and high-definition image display device.

9 Claims, 19 Drawing Sheets

IMAGE DISPLAY DEVICE AND TRANSMISSION SIGNAL CONTROL METHOD TO BE USED IN SAME

INCORPORATION BY REFERENCE

This application is based upon and claims the benefit of priorities from Japanese Patent Application Nos. 2010-208635, filed on Sep. 16, 2010 and 2011-105735 filed on May 10, 2011, the disclosures of which are incorporated herein in its entirety by reference.

BACKGROUND OF THE INVENTION

1. Field of the Invention

The present invention relates to an image display device and a transmission signal control method to be used in same and more particularly to the image display device and the transmission signal control method that can be suitably used when transmission wirings for data signal based on a video signal become complicated due to configurations of a large-sized and high-definition image display device.

2. Description of the Related Art

In an image display device such as a liquid crystal display device, there are mounted a driver IC to drive a display panel, a timing controller to output a control signal obtained by performing timing control and/or rearrangement process to an inputted video signal, to the driver IC, a power supply circuit to supply power to these ICs, and the like. Here, transmission of data signal to be inputted to the driver IC used to drive the display panel is studied. The driver IC and timing controller IC are electrically connected to each other through data signal transmission wirings. As a method for transmitting a data signal through the data signal transmission wirings, there are provided a parallel transmission method such as a CMOS transmission method and a differential signal transmission method such as a RSDS (Reduced Swing Differential Signaling) transmission method, and a mini-LVDS (Low Voltage Differential Signaling) transmission method.

However, the above methods for transmitting the data signal are one of reasons for heightening EMI (Electro-Magnetic Interference) emission levels in an image display device. In particular, in the case of using the CMOS transmission method, in the data signal transmission wirings each having the number corresponding to a gray level of a video signal to be inputted, the swing of a data signal occurs to cause a change of signal waveform within a voltage range (for example, 3.3V to 0V) between a source voltage and a ground level, which becomes a reason for the occurrence of a non-negligible amount of the EMI emissions. To reduce the EMI emissions, a transmission method using an invert signal is available. According to this transmission method, in the data signal transmission wirings each having the number corresponding to the gray level, all video signals are not swung, but, when the gray level of a present data signal is compared with a gray level of the data signal occurred before being transmitted and if an amount of change in gray levels is large, an invert signal is changed and polarities of all the signal are inverted. Even in the case of using the above method, in many cases, an image display device, a large-sized and high-definition type image display device in particular, is easily influenced by a gray level of a video signal to be inputted, arrangement of data signal transmission wirings, ground loop state of the image display device, thus resulting in suffering from high EMI emission levels, which further requires countermeasures.

In this case, a polarity of an invert signal is judged and determined for setting by comparing a change in polarity of a video signal with a previous gray level and, therefore, even in the case of a high level (H) or of a low level (L), the image display device operates normally and, as a result, the polarity of the invert signal at its initial stage is in an unstable state. Moreover, with the aim of avoiding a change in current to be consumed by the image display device, in many cases, all the polarities of the invert signal are fixedly set to be the same. In this state, a magnetic field is interfered and, in part out of current loops of an entire image display device, there probably occur many areas where magnetic fields are strengthened each other. For this reason, there is a fear that a non-negligible amount of the EMI emission occurs.

As a related art of this type, a driving circuit of a liquid crystal display device is disclosed in Patent Reference No. 1 (Japanese Patent Application Laid-open No. 2001-166740). In the driving circuit, as shown in FIG. 19, in every output port out of four ports, when the number of data signals whose polarities change exceeds the majority out of all outputs to bus lines, inverts the polarities of all data signals and outputs data signals BUS-A1-A24, BUS-B1 to B24, BUS-C1 to C24, BUS-D1 to D24 to bus lines from each output port. Moreover, as shown in FIG. 19, a controller 2 outputs, from every output port out of four output ports, polarity inverted signals INV-A to D each showing that the polarity of a data signal to be outputted has been inverted, to bus lines and, therefore, it is possible that the number of data signals whose polarities change can be reduced to a half or less of the number of data signals to be transferred.

However, the above related arts have following problems. That is, the driving circuit disclosed in the Patent Reference 1 is configured to reduce the number of data signals to be transferred through bus lines whose polarities change, but is not so configured that electromagnetic fields generated by currents cancel one another out. Therefore, the direction of a current flowing through the entire liquid crystal device cannot be controlled, thus it is made impossible to sufficiently reduce EMI emissions.

SUMMARY OF THE INVENTION

In view of the above, it is an object of the present invention to provide an image display device capable of reducing EMI emissions and a transmission signal control method to be applied to the image display device.

According to a first aspect of the present invention, there is provided an image display device including a display panel including a plurality of display regions each having predetermined columns of data lines, predetermined rows of scanning lines, and a plurality of pixel each disposed at an intersection between each of the data lines and each of the scanning lines;

a plurality of data line driving circuits each arranged on data line terminal side margins of the display panel to write pixel data, based on a transmitted data signal, to each of the data lines in a corresponding display region, a scanning line driving circuit to output a scanning driving signal for driving each scanning line in a predetermined order based on a given scanning control signal; and a signal processing unit, based on a given video signal, to generate a data signal and to transmit the generated data signal to a corresponding one of the data line driving circuits through a corresponding data signal transmission wiring and to generate the scanning control signal and to transmit the generated scanning control signal to the scanning driving circuit, wherein the processing unit includes:

a polarity inversion notification signal generating unit which compares, for each data line driving circuit, a gray level of the data signal with a gray level of the data signal before being transmitted to a corresponding one of the data line driving circuits, and if an amount of change in gray level is larger than a predetermined value, performs inversion of all polarities of the data signal to transmit to the corresponding one of the data line driving circuits and generates a polarity inversion notification signal showing that a polarity of the data signal has been already inverted to transmit to the corresponding one of the data line driving circuits through a corresponding notification signal transmission wiring; and a polarity inversion notification signal initial polarity setting unit which sets, for each notification signal transmission wiring, an initial polarity of the polarity inversion notification signal to be generated by the polarity inversion notification signal generating unit; and wherein each of the data line driving circuits inverts a polarity of the transmitted data signal based on the polarity inversion notification signal.

According to a second aspect of the present invention, there is provided a transmission signal control method to be applied to an image display device including:

a display panel including a plurality of display regions each having predetermined columns of data lines, predetermined rows of scanning lines, and a plurality of pixel each disposed at an intersection between each of the data lines and each of the scanning lines;

a plurality of data line driving circuits each arranged on data line terminal side margins of the display panel to write pixel data, based on a transmitted data signal, to each of each of the data lines in a corresponding display region;

a scanning line driving circuit to output a scanning driving signal to drive each of the scanning lines in a predetermined order based on a given scanning control signal; and a signal processing unit, based on a given video signal, to generate a data signal and to transmit the generated data signal to a corresponding one of data line driving circuits through a corresponding data signal transmission wiring and to generate the scanning control signal and to transmit the generated scanning control signal to the scanning driving circuit, and the transmission signal control method including:

a step of inverting polarities of all data signals, when a gray level of the data signal is compared with a gray level of the data signal occurred before being transmitted to each of data line driving circuits and if an amount of change in gray level is larger than a predetermined value, by using a polarity inversion notification signal generating section mounted on the signal processing unit, for each of the data line driving circuits, to transmit to a corresponding one of the data line driving circuits and generating a polarity inversion notification signal showing that polarities of all the data signals have been inverted to transmit to each of the data line driving circuits through the notification signal transmission wiring;

a step of setting, for every notification signal transmission line, an initial polarity of the polarity inversion notification signal to be generated by the polarity inversion notification signal generating section mounted on a polarity inversion notification signal initial polarity setting section; and a step of inverting a polarity of the transmitted data signal based on the polarity inversion notification signal by using each of the data line driving circuits.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Figure 1:
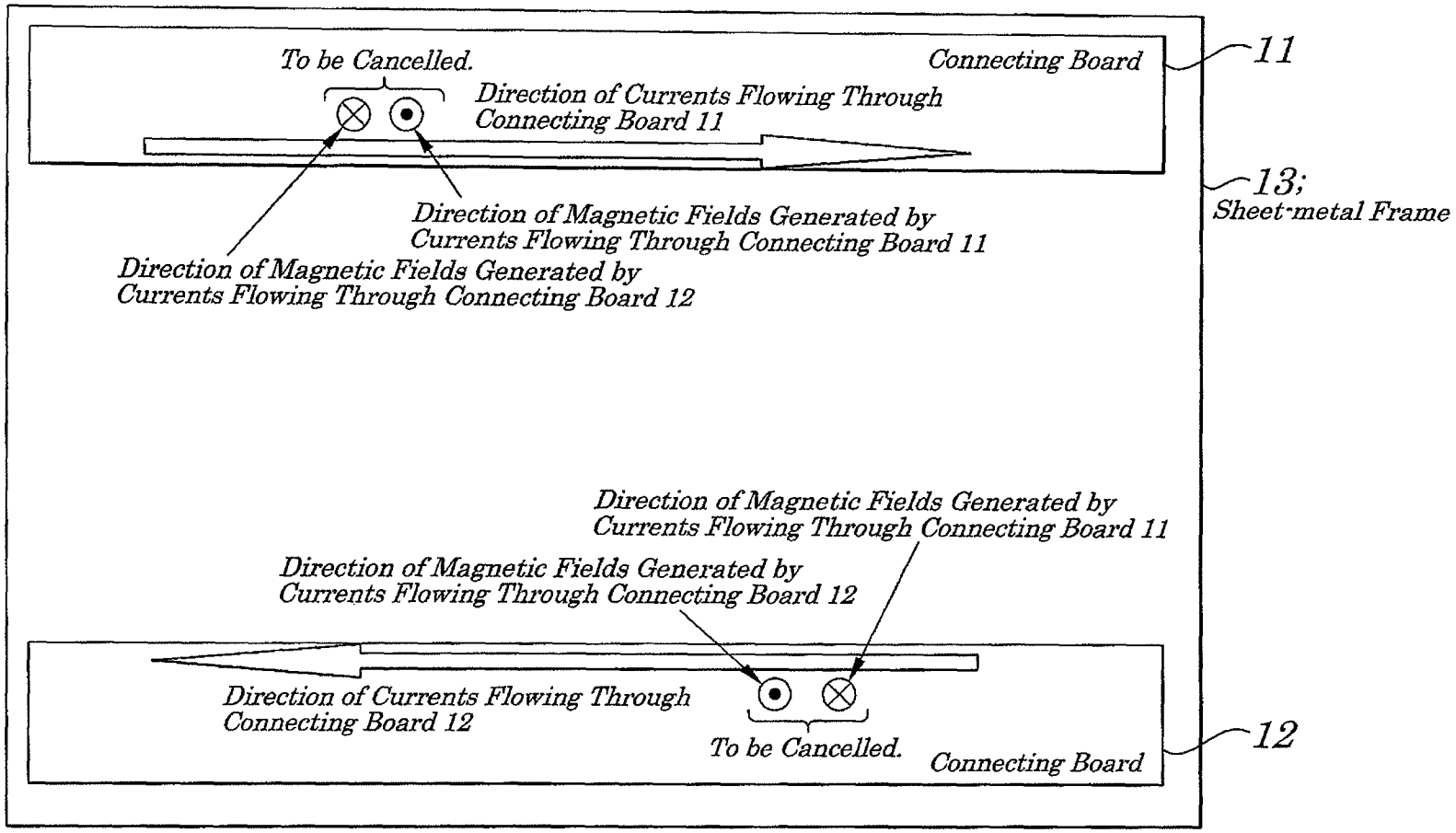
FIG. 1 is a conceptual diagram showing schematically a configuration of an image display device according to the present invention.

Best modes of carrying out the present invention will be described in further detail using various embodiments with reference to accompanying drawings.

There is provided an image display device in which an invert signal generating section, if the number of data signals whose polarities change exceeds a majority when present data signals are compared with data signals occurred before being transmitted, inverts all polarities of the data signal.

Data line driving circuits are mounted on an upper data line terminal side margin of a display panel and on a lower data line terminal side margin of the display panel and a polarity inversion notification signal initial polarity setting section sets an initial polarity of a polarity inversion notification signal to be generated by a polarity inversion notification section so that a polarity of a data signal current flowing through a data line driving circuit disposed on the upper data line terminal side margin of the display panel is reversed to that of the polarity of a data signal current flowing through a data line driving circuit disposed on the lower data line terminal side margin of the display panel.

Moreover, each of the data line driving circuits is mounted on the upper data line terminal side margin of the display panel and on the lower data line terminal side margin of the display panel and the polarity inversion notification signal initial polarity setting section sets an initial polarity of a polarity inversion notification signal to be generated by the polarity inversion notification section so that the polarity of a data signal current flowing through the data line driving circuit disposed on the left upper data line terminal side margin of the display panel is reversed to that of the polarity of a data signal current flowing through the data line driving circuit disposed on the left lower data line terminal side margin of the display panel and so that the polarity of a data signal current flowing through a data line driving circuit disposed on the right upper data line terminal side margin of the display panel is reversed to that of the polarity of a data signal current flowing through the data line driving circuit disposed on the right lower data line terminal side margin of the display panel and so that the polarity of a data signal current flowing through the data line driving circuit disposed on the left upper data line terminal side margin of the display panel is reversed to that of the polarity of a data signal current flowing through the data line driving circuit disposed on the right upper data line terminal side margin of the display panel.

Further, the above image display device has a first board disposed on the upper side of the display panel to connect each of the data line driving circuits arranged on the upper side of the display panel to a corresponding one of data lines, a second board disposed on the lower side of the display panel to connect each of the data line driving circuits arranged on the lower side of the display panel to a corresponding one of data lines, and a housing made of a conductive material to which a left side terminal portion, almost central portion, and right side terminal portion of a ground pattern on the first board are connected and a left side terminal portion, almost central portion, and right side terminal portion of the ground pattern on the second board are electrically connected.

The image display device according to a preferable mode of the present invention also includes the display panel including a plurality of display regions each having predetermined columns of data lines, predetermined rows of scanning lines, and a plurality of pixel each disposed at an intersection between each of the data lines and each of the scanning lines, two data line driving circuits arranged on the data line terminal side margin of the display panel configured to write pixel data, based on a transmitted data signal, to each of the data lines in each display region, a scanning line driving circuit configured to output a scanning driving signal to drive each scanning line in a predetermined order according to a given scanning control signal, and a signal processing unit, based on a given video signal, to generate the data signal and to transmit the generated data signal to a corresponding data line driving circuit through a corresponding data signal transmission wiring and to generate the scanning control signal and to transmit the generated scanning control signal to the scanning driving circuit, wherein the signal processing unit performs the setting of the direction of a current of the data signal so that the direction of the data signal current flowing through one of the data line driving circuit becomes reversed to the direction of the data signal current flowing through another of the data line driving circuit. In such a preferable mode, each of the above two data line driving circuits is disposed on a data line terminal side margin on an upper or lower portion of the display panel.

The image display device according to a preferable mode of the present invention also includes the display panel including a plurality of display regions each having predetermined columns of data lines, predetermined rows of scanning lines, and a plurality of pixel each disposed at an intersection between each of the data lines and each of the scanning lines, two data line driving circuits each arranged on a data line terminal side margin of an upper or lower portion of the display panel each configured to write pixel data produced based on a transmitted data signal to each data line in each display region, a scanning line driving circuit configured to output a scanning driving signal to drive each scanning line in a predetermined order according to a given scanning control signal, a signal processing unit to generate the data signal and to transmit the generated data signal to a corresponding data line driving circuit through a corresponding data signal transmission wiring according to a given video signal, wherein the above signal processing unit is configured to send out the data signal to each of data signal transmission wirings in a same phase and each data signal transmission wiring is arranged so that the direction of the data signal of a current flowing through one of the data line driving circuit becomes reversed to the direction of the data signal of a current flowing through another of the data line driving circuit.

The image display device according to a preferable mode of the present invention also includes the display panel including a plurality of display regions each having predetermined columns of data lines, predetermined rows of scanning lines, and a plurality of pixel each disposed at an intersection between each of the data lines and each of the scanning lines, four data line driving circuits each arranged on a data line terminal side margin of a left upper, left lower, right upper, or right lower portion of the display panel each configured to write pixel data produced based on a transmitted data signal to each data line in each display region, a scanning line driving circuit configured to output a scanning driving signal to drive each scanning line in a predetermined order according to a given scanning control signal, a signal processing unit to generate the data signal and to transmit the generated data signal to a corresponding data line driving circuit through a corresponding data signal transmission wiring according to a given video signal, wherein the above signal processing unit is configured to send out the data signal to each of data signal transmission wirings in a same phase and each of the data signal transmission wirings is arranged so that the direction of the data signal of a current flowing through the data line driving circuit disposed on the left upper side of the display panel becomes reversed to the direction of the data signal of a current flowing through the data line driving circuit disposed on the left lower side of the display panel and so that the direction of the data signal of a current flowing through the data line driving circuit disposed on the right upper side of the display panel becomes reversed to the direction of the data signal of a current flowing through the data line driving circuit disposed on the right lower side of the display panel, and so that the direction of the data signal of a current flowing through the data line driving circuit disposed on the left upper side of the display panel becomes reversed to the direction of the data signal of a current flowing through the data line driving circuit disposed on the right upper side of the display panel.

FIG. 1 is a conceptual diagram showing a configuration of an image display device according to a preferable mode of the present invention. The image display device has a connecting board 11, a connecting board 12, and a sheet-metal frame 13. The connecting board 11 is configured to connect a plurality of data line driving circuits (source drivers) disposed on an upper side of an unillustrated display panel, which is, for example, a liquid crystal display panel, with a corresponding data line of the display panel. The connecting board 12 is configured to connect a plurality of data line driving circuits (source drivers) disposed on a lower side of the display panel with a corresponding data line of the display panel. The display panel, the connecting board 11, and the connecting board 12 are housed in the sheet-metal frame 13. In the image display device, a magnetic field generated by a current flowing through the connecting board 11 and a magnetic field generated by a current flowing through the connecting board 12 cancel each other. Also, the magnetic field generated by a current flowing through the connecting board 12 and a magnetic field generated by a current flowing through the connecting board 11 cancel each other.

First Embodiment

Figure 2:
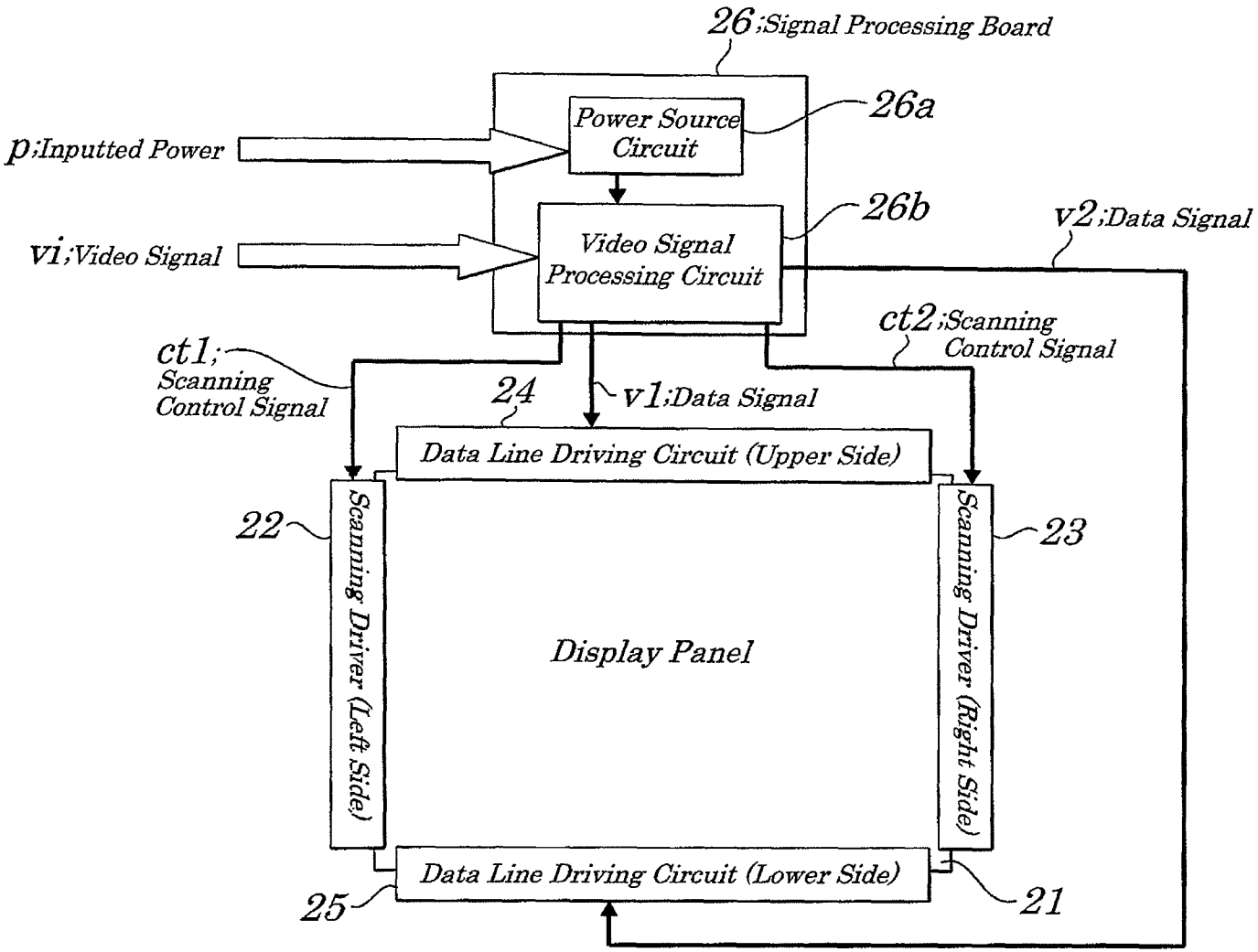
FIG. 2 is a block diagram showing main portions of the image display device according to a first exemplary embodiment of the present invention.

FIG. 2 is a block diagram showing main portions of an image display device of the first exemplary embodiment of the present invention. The image display device of the exemplary embodiment being a liquid crystal display device, includes, as shown in FIG. 2, a display panel 21, scanning drivers 22 and 23, data line driving circuits 24 and 25, and a signal processing board 26. The display panel 21 is made up of a liquid crystal panel having predetermined columns of data lines (not shown), predetermined rows of scanning lines (not shown), and each pixel disposed at the intersection between each of the data lines and each of the scanning lines.

The scanning driver 22, based on a scanning control signal ct1 fed from the signal processing board 26, outputs a scanning line driving signal to drive each scanning line on a left side in a predetermined order (for example, line-sequentially). The scanning driver 23, based on a scanning control signal ct2 fed from the signal processing board 26, output a scanning line driving signal to drive each scanning line on a right side line-sequentially. In the data line driving circuit 24, a plurality of unillustrated source drivers is arranged on the data line terminal side margin on an upper side of the display panel 21 by using, for example, a COG (Chip On Glass) mounting method, a COF (Chip On Film) mounting method, a TCP (Tape Carrier Package) mounting method, or the like and each of the drivers writes pixel data based on a parallel (for example, 8 bit) data signal v1 transmitted from the signal processing board 26 in each data line in a corresponding (that is, assigned) display region. In the data line driving circuit 25, a plurality of unillustrated source drivers is arranged on a data line terminal side margin on a lower side of the display panel 21 in the same manner as in the case of the upper side and each driver writes pixel data based on a parallel data signal v2 transmitted from the signal processing board 26 in each data line in a corresponding display region.

The signal processing board 26 has a power source circuit 26*a* and a video signal processing circuit (IC) 26*b*. The power source circuit 26*a*, by using inputted power "P" to be supplied from, for example, a personal computer, monitor set, or the like, generates and supplies power required by the image display device through a DC/DC converter or the like. The video signal processing circuit 26*b* performs processing of rearranging to a predetermined format and of outputting timing control on a given video signal vi to generate data signals v1 and v2 and to transmit these signals to the data line driving circuits 24 and 25 and also generates scanning control signals ct1 and ct2 to supply these signals to the scanning drivers 22 and 23.

Figure 3:
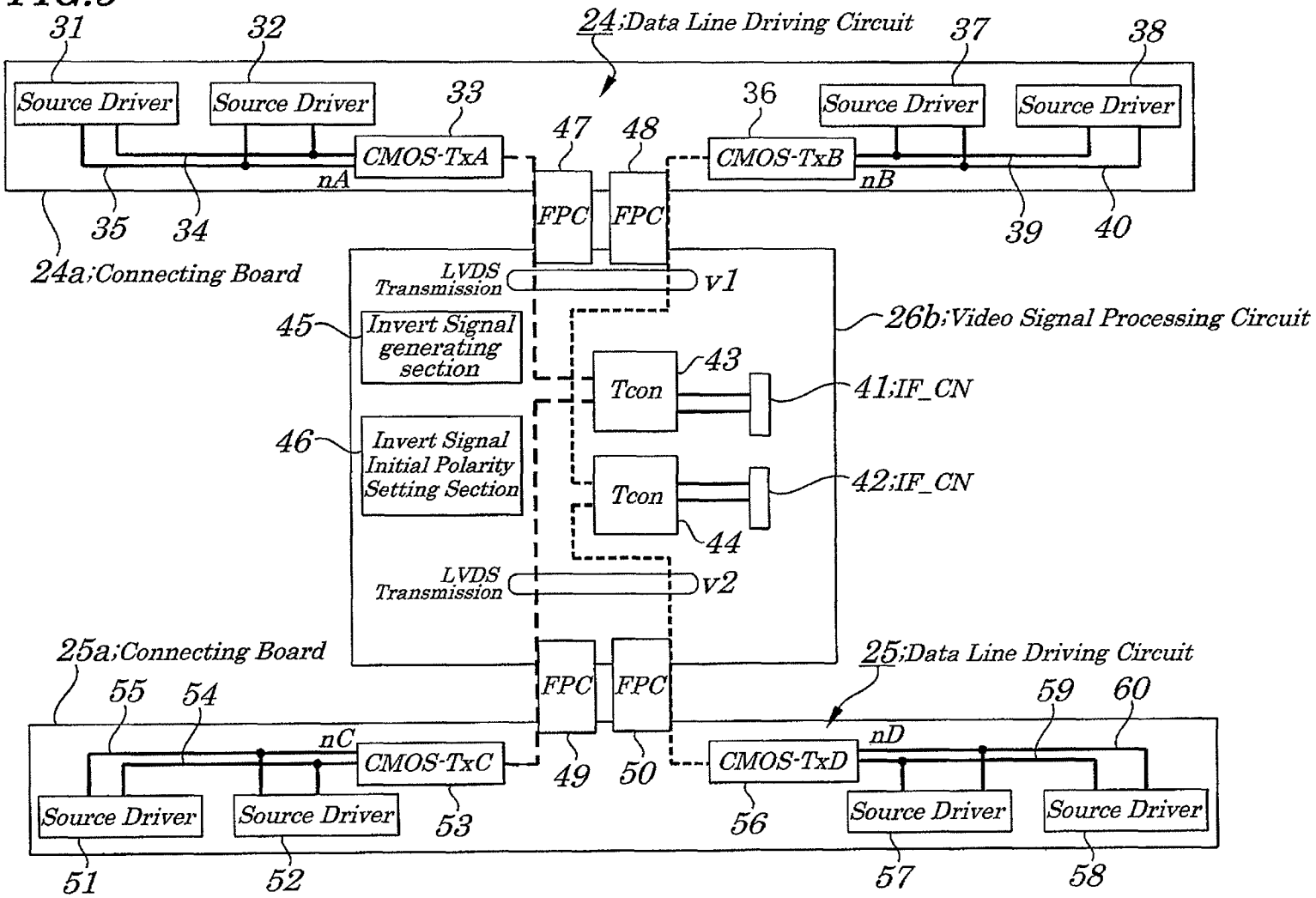
FIG. 3 is a diagram showing an internal configuration of data line driving circuits and a video signal processing circuit shown in FIG. 2.

FIG. 3 is a diagram showing an internal configuration of the data line driving circuits 24 and 25 and video signal processing circuit 26*b* shown in FIG. 2.

The data line driving circuit 24, as shown in FIG. 3, is mounted on a connecting board 24*a*. The connecting board 24*a* has source drivers 31 and 32, a CMOS interface (CMOS-TxA) 33, a data bus (data signal transmission wiring) 34, and a notification signal transmission wiring 35. The connecting board 24*a* has a CMOS interface (CMOS-TxB) 36, source drivers 37 and 38, a data bus (data signal transmission wiring) 39, and a notification signal transmission wiring 40. The above source drivers 31, 32, 37, and 38, each formed by the COF or TCP mounting methods, are connected to a corresponding data line of the display panel 21, through an unillustrated FPC (Flexible Printed Circuit). The data line driving circuit 25 is implemented on a connecting board 25*a*. The connecting board 25*a* has source drivers 51 and 52, a CMOS interface (CMOS-TxC) 53, a data bus (data signal transmission wiring) 54, and a notification signal transmission wiring 55. The connecting board 25*a* has a CMOS interface (CMOS-TxD) 56, source drivers 57 and 58, a data bus (data signal transmission wiring) 59, and a notification signal transmission wiring 60. The above source drivers 51, 52, 57, and 58, each formed by the COF or TCP mounting methods, are connected to a corresponding data line of the display panel 21, through an unillustrated FTC.

The video signal processing circuit 26*b* includes interface connectors (I/F_CN) 41 and 42, timing controllers (Tcon) 43 and 44, an invert signal generating section 45, an invert signal initial polarity setting section 46 and is connected through flexible boards (FPC) 47 and 48 to the connecting board 24*a* and through flexible boards (FPC) 49 and 50 to the connecting board 25*a*. A video signal vi is inputted into the interface connectors (I/F_CN) 41 and 42. The timing controllers (Tcon) 43 and 44, after performing processing of rearranging to a predetermined format and of outputting timing control on the inputted video signal vi to generate data signals v1 and v2.

The invert signal generating section 45, when a gray level of the present data signal v1 to be transmitted to the source drivers 31 and 32 is compared with a gray level of the data signal v1 occurred before being transmitted to the source drivers 31 and 32 and if an amount of change in gray level is larger than a predetermined value, performs inversion of all polarities of the data signal v1 to transmit to the source drives 31 and 32 through the CMOS interface (CMOS-TxA) 33 and through the data bus 34 and generates an invert signal (polarity inversion notification signal) nA showing that the polarity of the data signal v1 has been already inverted to transmit to the source drivers 31 and 32 through the notification signal transmission wiring 35. Also, the invert signal generating section 45, when a gray level of the present data signal v1 is compared with a gray level of the data signal v1 occurred before being transmitted to each of the source drivers 51 and 52 and if an amount of change in gray level is larger than a predetermined value, performs inversion of all polarities of the data signal v1 to transmit to the source drives 37 and 38 through the CMOS interface (CMOS-TxB) 36 and through the data bus 39 and generates the invert signal (polarity inversion notification signal) nB showing that the polarity of the data signal v1 has been already inverted to transmit to the source drivers 37 and 38 through the notification signal transmission wiring 40.

The invert signal generating section 45, when a gray level of the present data signal v2 to be transmitted to the source drivers 51 and 52 is compared with a gray level of the data signal occurred before being transmitted to each of the source drivers 51 and 52 and if an amount of change in gray level is larger than a predetermined value, performs inversion of all polarities of the data signal v2 to transmit to the source drivers 51 and 52 through the CMOS interface (CMOS-TxC) 53 and through the data bus 54 and generates the invert signal (polarity inversion notification signal) nC showing that the polarity of the data signal v2 has been already inverted to transmit to the source drivers 51 and 52 through the notification signal transmission wiring 55. Also, the invert signal generating section 45, when a gray level of the present data signal v2 to be transmitted to the source drivers 57 and 58 is compared with a gray level of the data signal before being transmitted to each of the source drivers 51 and 52 and if an amount of change in gray level is larger than a predetermined value, performs inversion of all polarities of the signal v2 to transmit to the source drives 51 and 52 through the CMOS interface (CMOS-TxD) 56 and through the data bus 59 and generates the invert signal (polarity inversion notification signal) nD showing that the polarity of the data signal v2 has been already inverted to transmit to the source drivers 57 and 58 through the notification signal transmission wiring 60. In this case, the invert signal generating section 45, if the number of the data signals whose polarities change exceeds the majority when the present data signals v1 and v2 are compared with the data signals occurred before being transmitted, inverts all the polarities of the data signals v1 and v2. When parallel 8-bit data signals are to be transmitted according to the CMOS transmission method, the gray levels of R (Red), G (Green), and B (Blue) are included and, therefore, 24 pieces (8×3) of buses are required for each of the above data buses 34, 39, 54, and 59. Transmission lines for clock signals are also required.

The invert signal initial polarity setting section 46 is configured to set an initial polarity of each of the invert signals nA, nB, nC, and nD generated by the invert signal generating section 45 for each of the notification signal transmission wirings 35, 40, 55, and 60. The source drivers 31 and 32, based on the invert signal nA, invert the polarity of the transmitted data signal v1 (that is, returns the polarity to its original state). The source drivers 37 and 38, based on the invert signal nB, invert the polarity of the transmitted data signal v1 (that is, returns the polarity to its original state). The source drivers 51 and 52, based on the invert signal nC, invert the polarity of the transmitted data signal v2 (that is, returns the polarity to its original state). The source drivers 57 and 58, based on the invert signal nD, invert the polarity of the transmitted data signal v (that is, returns the polarity to its original state).

Figure 4:
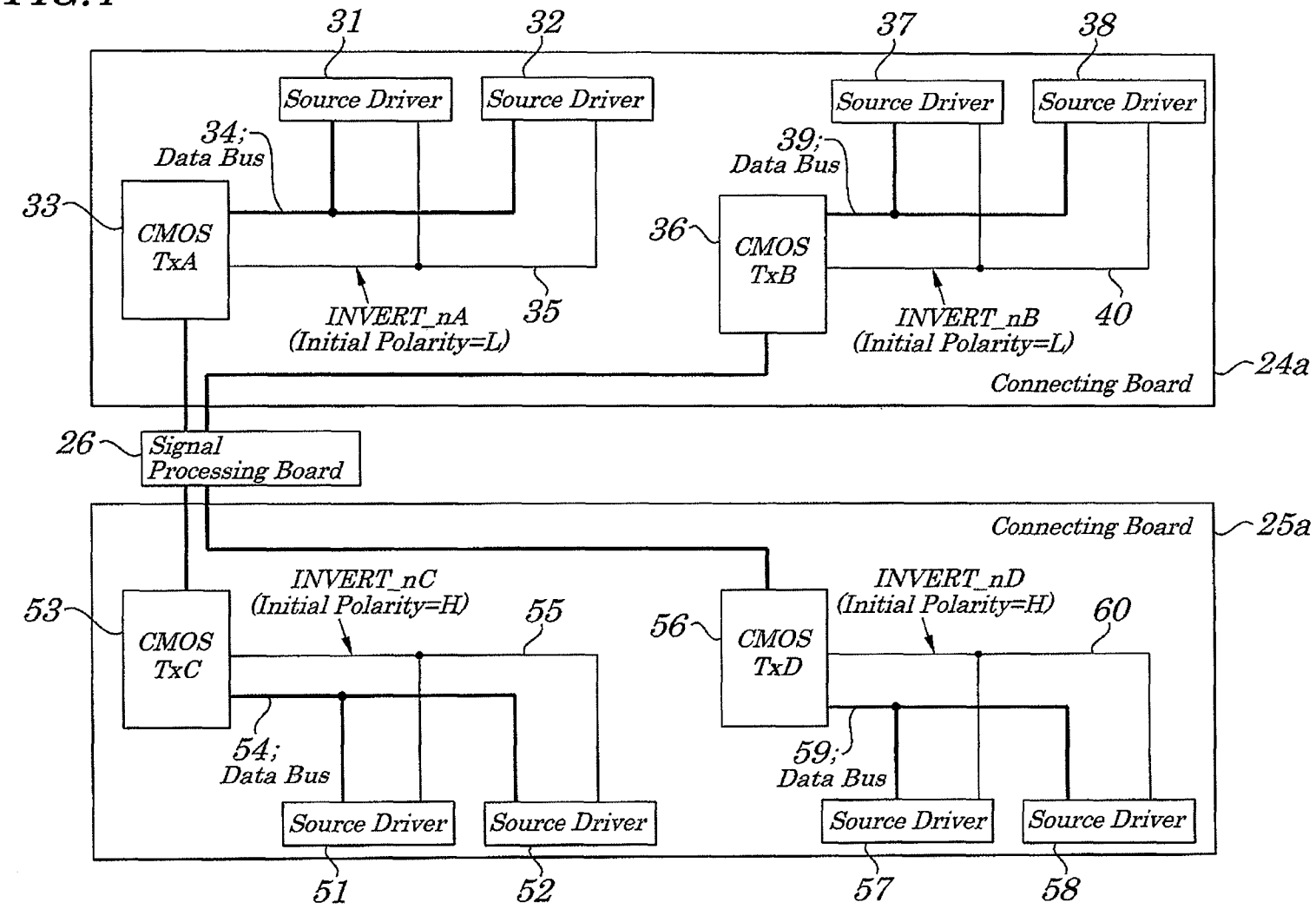
FIG. 4 is a diagram showing a setting example of an initial polarity of each of invert signals nA, nB, nC, and nD by an invert signal initial polarity setting section shown in FIG. 3.

FIG. 4 is a diagram showing a setting example of an initial polarity of each of the invert signals nA, nB, nC, and nD by the invert signal initial polarity setting section 46, shown in FIG. 3.

As shown in FIG. 4, by the invert signal initial polarity setting section 46, the initial polarity of the invert signal (INVERT_) nA to be supplied to the source drivers 31 and 32 mounted on the upper side of the display panel 21 and of the invert signal (INVERT_) nB to be supplied to the source drivers 37 and 38 mounted on the upper side of the display panel 21 are respectively reversed to that of the invert signals (INVERT_) nC to be supplied to the source drivers 51 and 52 mounted on the lower side of the display panel 21 and to that of the invert signals (INVERT_) nD to be supplied to the source drivers 57 and 58 mounted on the lower side of the display panel 21. That is, the initial polarities of the invert signals (INVERT_) nA and nB are set to be "L" and the initial polarities of the invert signals (INVERT_) nC and nD are set to be "H".

Figures 5A, 5B:
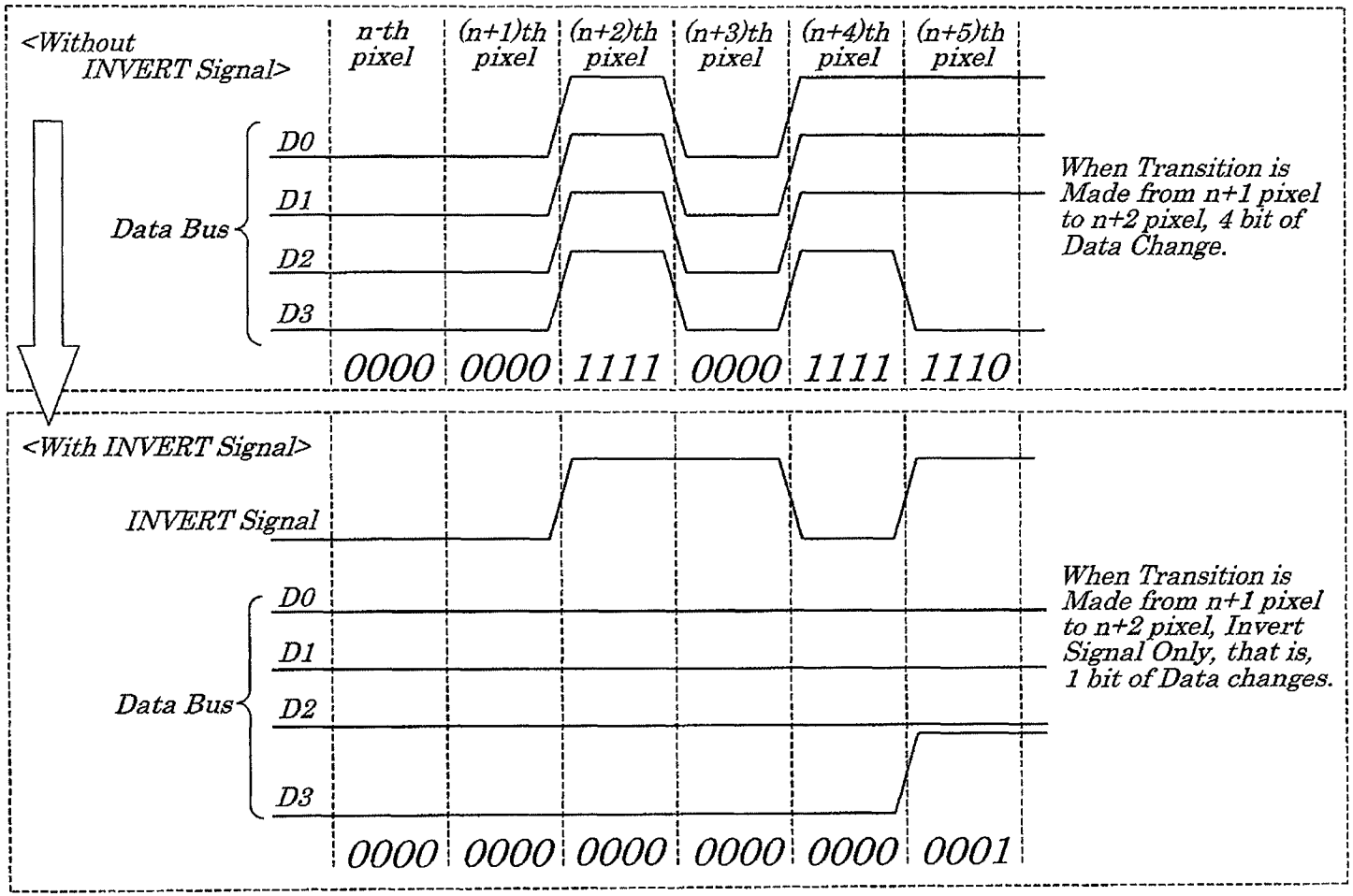
FIGS. 5A and 5B are diagrams explaining functions of an invert signal generating section shown in FIG. 3.
Figure 6:
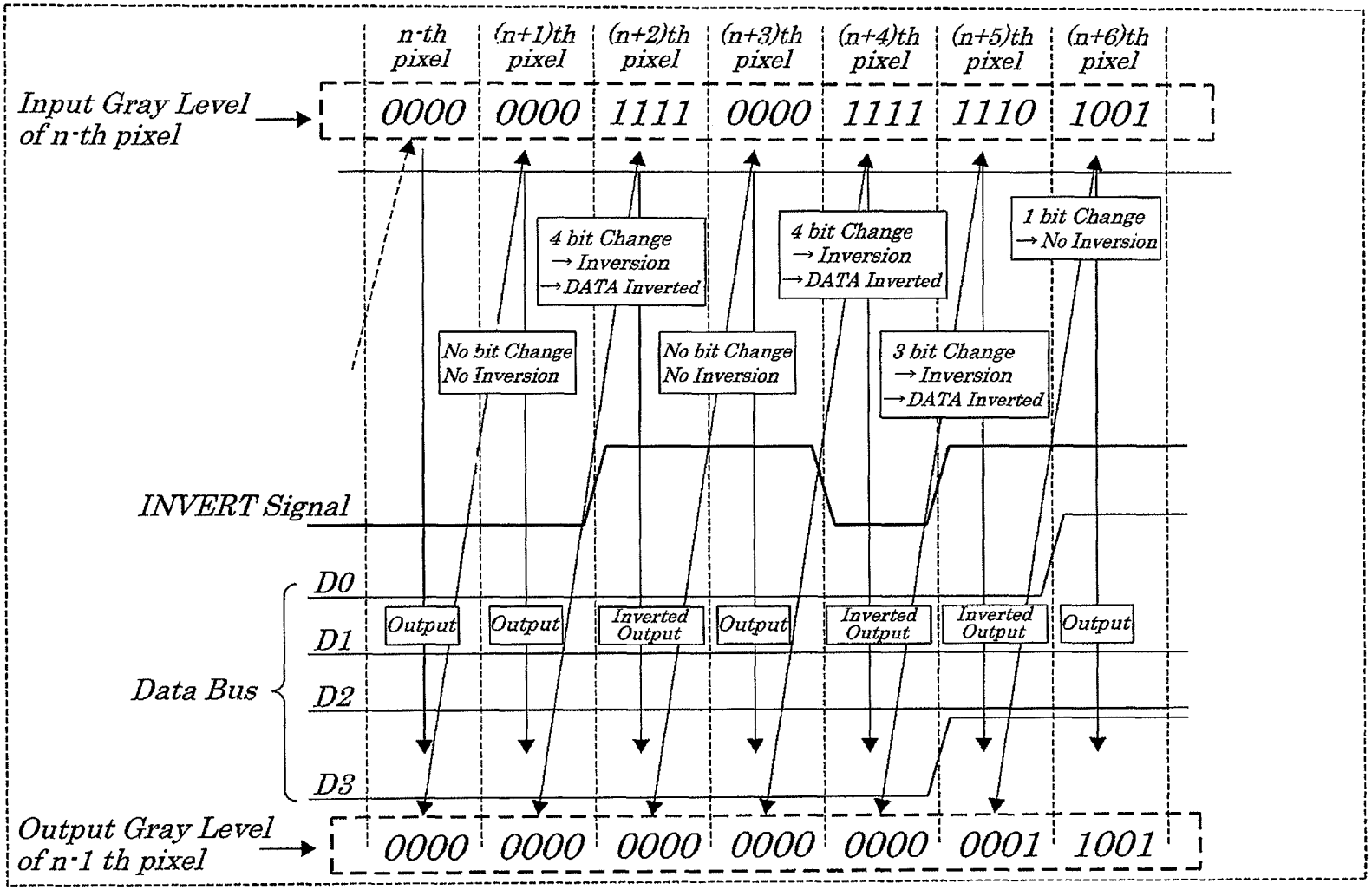
FIG. 6 is a diagram explaining functions of the invert signal generating section shown in FIG. 3.

FIGS. 5 and 6 are diagrams explaining functions of the invert signal generating section 45.

As shown in FIG. 5A, when no invert signal is supplied from the invert signal generating section 45, in the case of, for example, 4-bit data buses D0, D1, D2, and D3, if transition is made from the n+1 pixel to n+2 pixel, 4 bits of data change, however, as shown in FIG. 5B, when the invert signal is supplied from the invert signal generating section 45, if transition is made from the n+1 pixel to n+2 pixel, the invert signal only, that is, 1 bit of data only changes. In this case, as shown in FIG. 6, bit data between the input gray level of N (n, n+1, . . . )-th pixel and the output gray level of N−1 th pixel is compared and, if the number of the data signals whose polarities change exceeds the majority when the present data signals are compared with the data signals occurred before being transmitted, the invert signal is outputted. This shows that the supply of the invert signal enables reduction in the change amount of the data bus. Namely, reducing the change amount of the data bus is that EMI emission levels can be lowered.

Here, a polarity of an invert signal is described. As shown in FIG. 5B, the polarities of all data on D0 to D3 for the n-th pixel are "L" ("0") and are represented as "0000". At this point of time, the polarity of the invert signal is "L", however, the polarity of the invert signal may be "H". If the polarity of the invert signal for the n-th pixel is "H", the polarity of the invert signal for the (n+1) th pixel becomes "H" and the polarity of the invert signal for the (n+2) th pixel becomes "L". That is, all that is needed is that the polarity of the invert signal changes at the point of time when the data bus changes. Thus, the polarity of the initial state of the invert signal may be either of "L" or "H".

Figure 7:
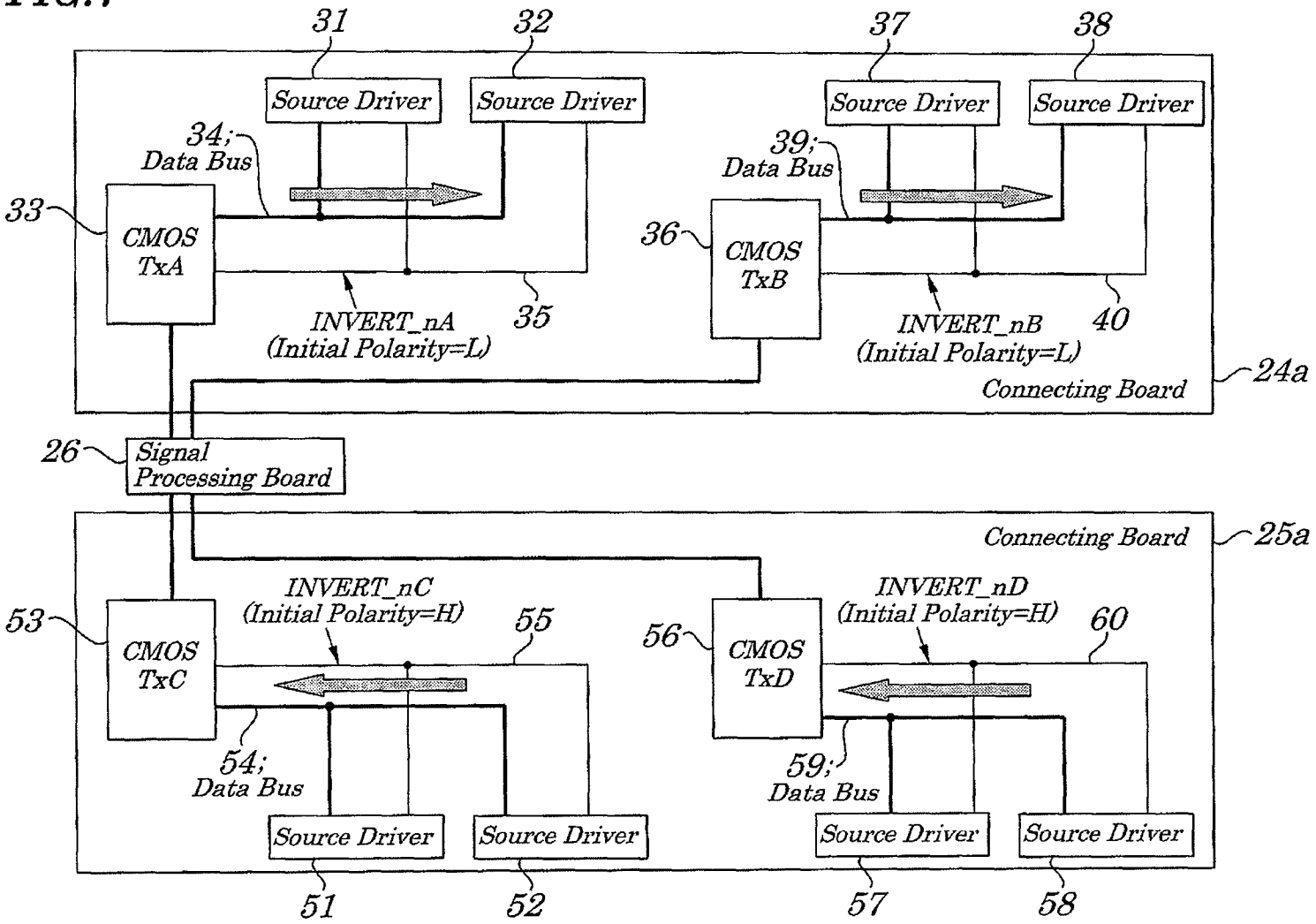
FIG. 7 is a diagram showing an example of a direction of a current at a point of time for each data bus according to the first exemplary embodiment.
Figure 8:
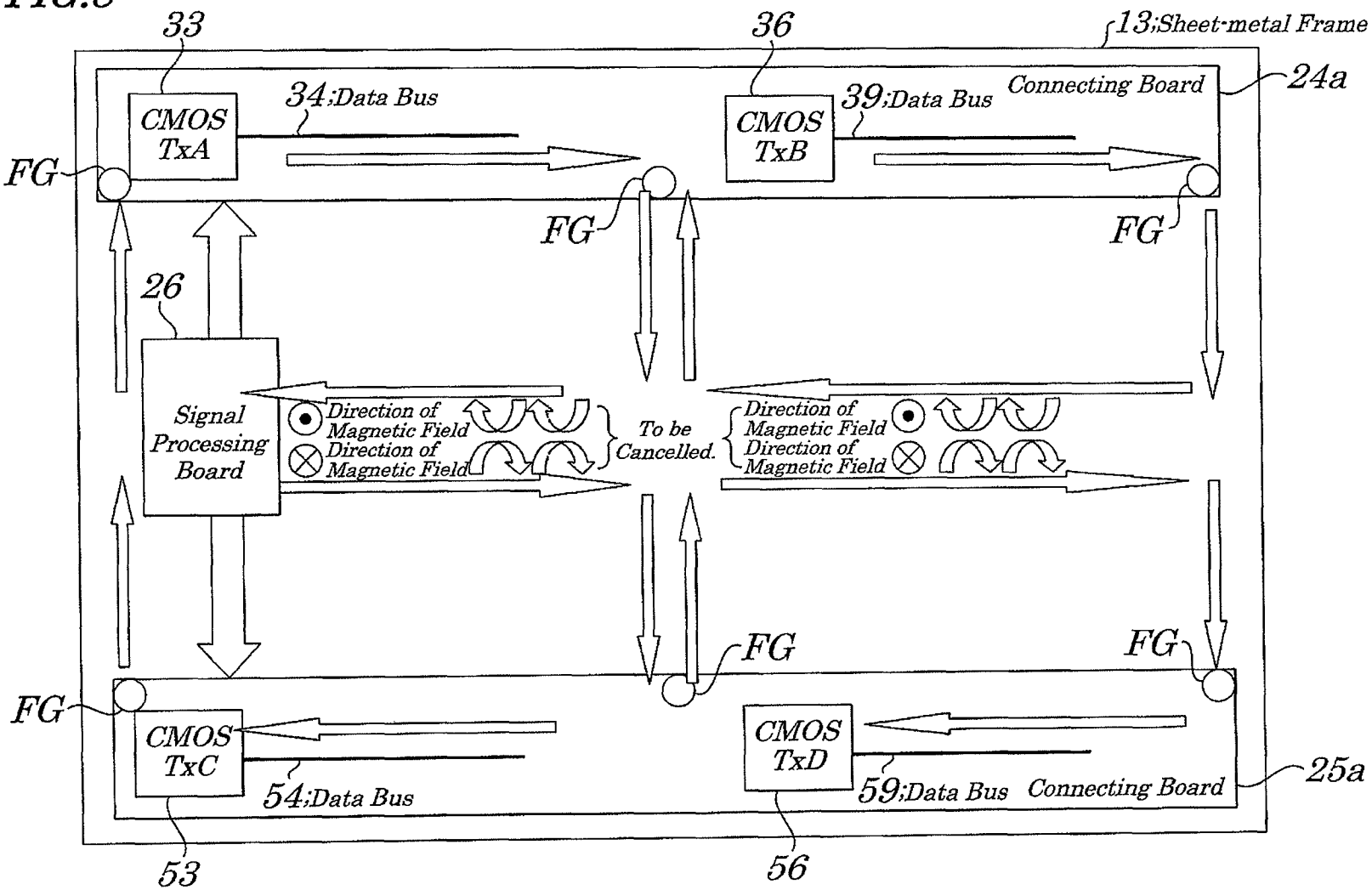
FIG. 8 is an example of the direction of a current and direction of a magnetic field generated by the current at a point of time for each data bus in a state where ground patterns on connecting boards are connected to a sheet-metal frame according to the first exemplary embodiment.
Figure 9:
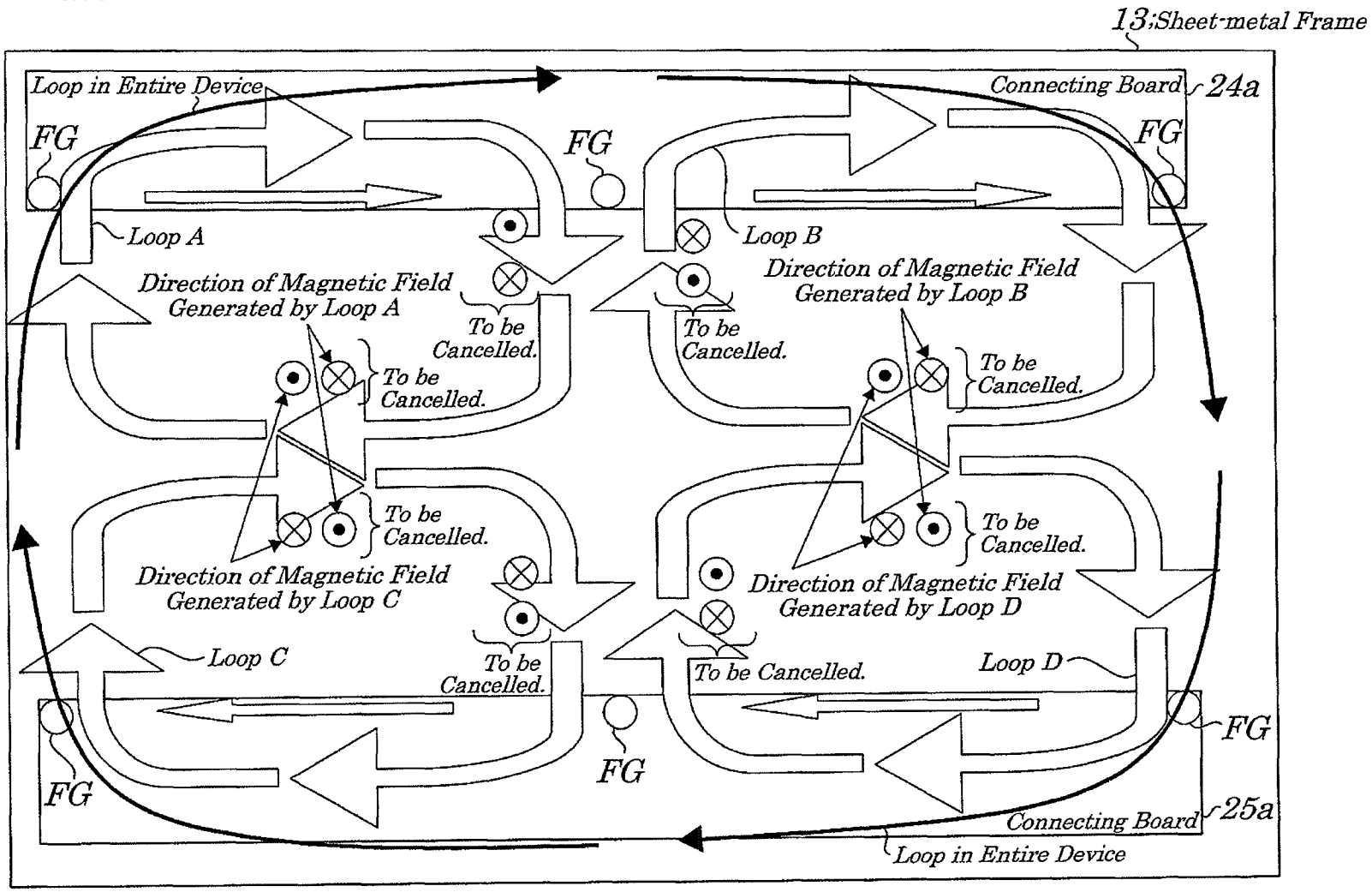
FIG. 9 is a diagram showing a current loop and direction of a magnetic field at a point of time in the sheet-metal frame according to the first exemplary embodiment.

FIG. 7 is a diagram showing an example of a direction of a current at a point of time for the data buses 34, 39, 54, and 59. FIG. 8 is an example of a direction of a current and direction of a magnetic field generated by the current at a point of time for the data buses 34, 39, 54, and 59 in a state where ground patterns on the connecting boards 24*a* and 25*a* are connected to the sheet-metal frame 13. FIG. 9 is a diagram showing current loops and the direction of the magnetic field at a point of time in the sheet-metal frame 13.

By referring to these drawings, contents of processing of a transmission signal control method used in the image display device of this type.

In the image display device, the invert signal generating section 45, if the number of the data signals whose polarities change exceeds the majority when the present data signals are compared with the data signals before being transmitted, inverts all polarities of the data signals v1 and v2. Further, by the invert signal initial polarity setting section 46, the initial polarity of the invert signal generated by the invert signal generating section 45 to be supplied to the data line driving circuit 24 mounted on the upper side of the display panel 21 is reversed to that of the invert signal to be supplied to the data line driving circuit 25 mounted on the lower side of the display panel 21. To a housing made of conductive materials are electrically connected a left side terminal portion, almost central portion, right side terminal portion of the ground pattern on the connecting board 24*a* and a left side terminal portion, almost central portion, and right side terminal portion of the ground pattern on the connecting board 25*a*.

That is, as shown in FIG. 7, the initial polarities of the invert signal (INVERT_) nA and nB are set to be "L" and the initial polarities of the invert signal (INVERT_) nC and nD are set to be "H" and the direction of a current flowing through the data buses 34 and 39 on the connecting board 24*a* at a point of time are reversed to the direction of a current flowing through the data buses 54 and 59 on the connecting board 25*a* at a point of time. As a result, as shown in FIG. 8, when the left side terminal portion, almost central portion, and right side terminal portion of the ground pattern on the connecting board 24*a* and the left side terminal portion, almost central portion, and right side terminal portion of the ground pattern on the connecting board 25*a* are electrically connected to the sheet-metal frame (housing) 13, in each portion of FGs (frame grounds), current loops generating an entire loop in the image display device are partially reversed at a point of time and, therefore, the directions of magnetic fields become reversed in the portion of each frame ground and the magnetic fields cancel each other out. As a result, as shown in FIG. 9, the magnetic field generated by the current loop A and magnetic field generated by the current loop C cancel each other out. The magnetic field generated by the current loop A and magnetic field generated by the current loop C and the magnetic field generated by the current loop B cancel each other out. The magnetic field generated by the current loop B and magnetic field generated by the current loop D cancel each other out. The magnetic field generated by the current loop C and magnetic field generated by the current loop D cancel each other out. In this case, in the entire image display device, a clockwise current loop is generated.

As described above, according to the first exemplary embodiment, the direction of currents of each data signal of the data buses 34 and 39 on the connecting board 24*a* at a point of time becomes reversed to the direction of currents of each data signal of the data buses 54 and 59 on the connecting board 25*a* and, therefore, the magnetic fields generated by the current loop in the image display device partially cancel each other out, which, as a result, lowers EMI emission levels.

Second Embodiment

Figure 10:
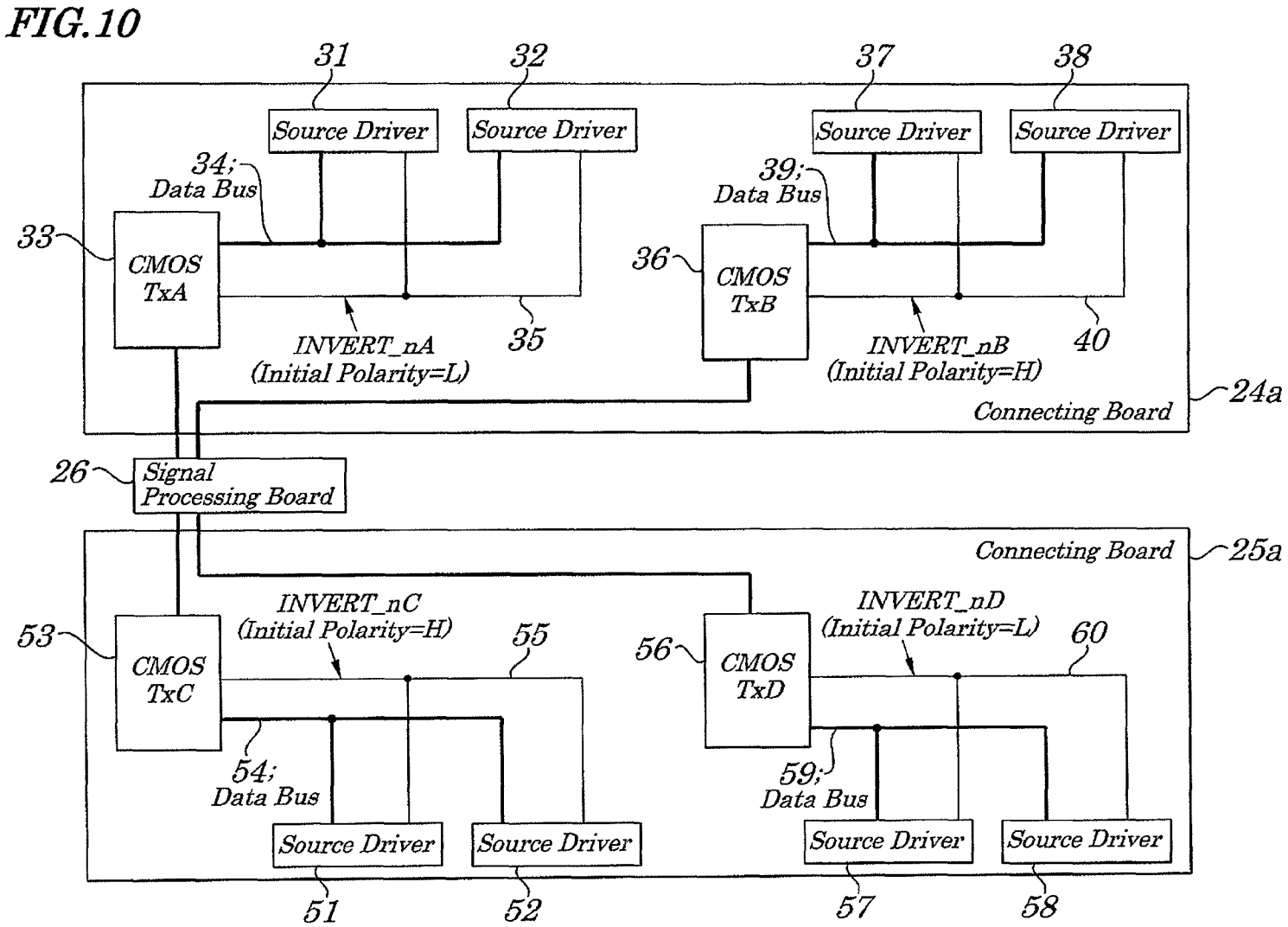
FIG. 10 is another example of setting initial polarities of invert signals nA, nB, nC, and nD by an invert signal initial polarity setting section shown in FIG. 3 according to a second exemplary embodiment of the present invention.

FIG. 10 is another example of setting initial polarities of invert signals nA, nB, nC, and nD by an invert signal initial polarity setting section 46 in FIG. 3, according to a second exemplary embodiment of the present invention.

The invert signal initial polarity setting section 46, as shown in FIG. 10, performs the setting so that the initial polarity of the invert signal nA to be supplied to the source drivers 31 and 32 mounted on the left upper side of the display panel 21 is reversed to that of the invert signal nC to be supplied to the source drivers 51 and 52 mounted on the left lower side of the display panel 21 and so that the initial polarity of the invert signal nB to be supplied to the source drivers 37 and 38 mounted on the right upper side of the display panel 21 is reversed to that of the invert signal nD to be supplied to the source drivers 57 and 58 mounted on the right lower side of the display panel 21. That is, the initial polarities of the invert signal (INVERT_) nA and nD are set to be "L" and the initial polarities of the invert signal (INVERT_) nB and nC are set to be "H".

Figure 11:
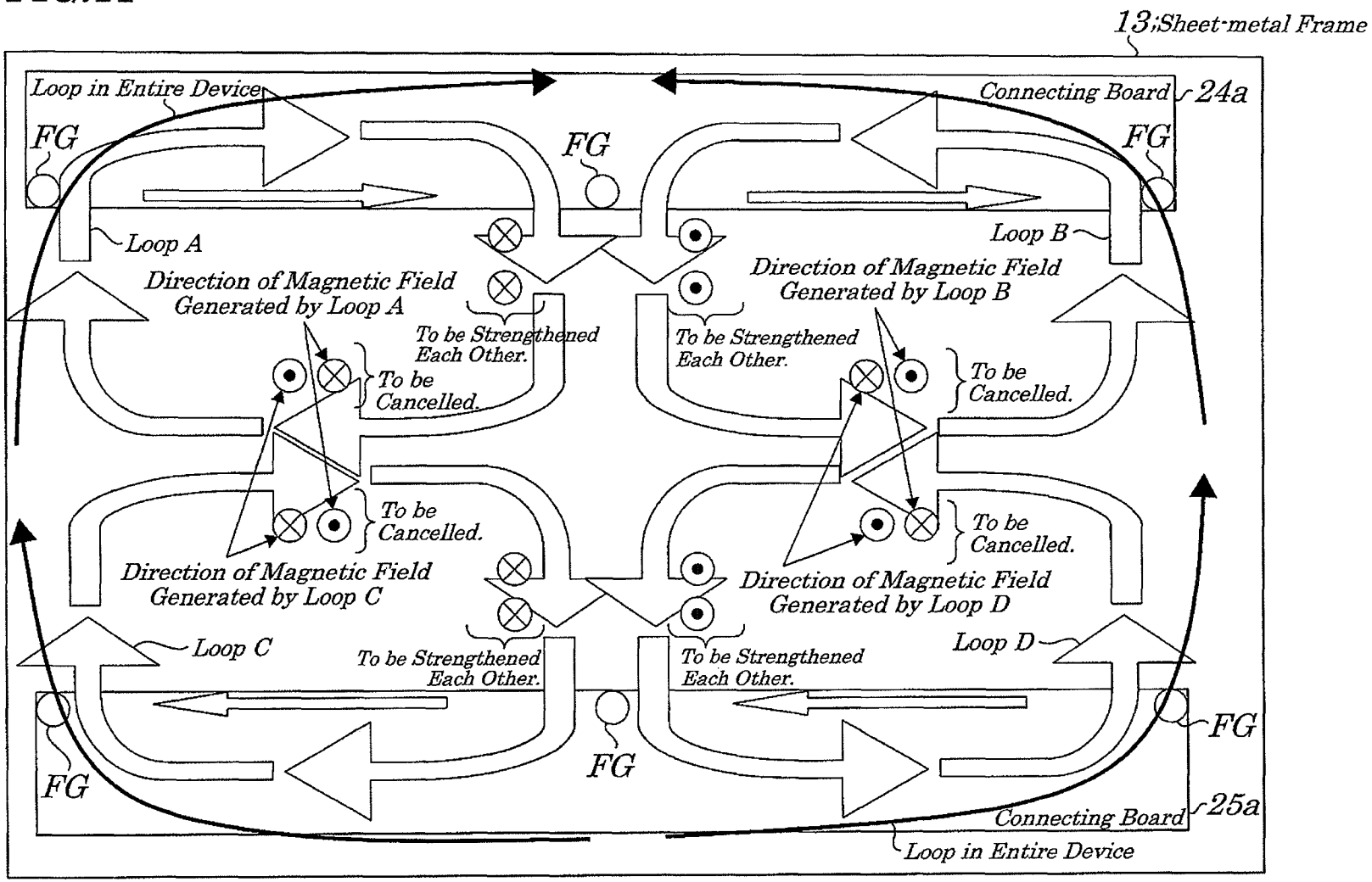
FIG. 11 is a diagram showing an example of a current loop and direction of a magnetic field in a sheet-metal frame at a point of time according to the second exemplary embodiment of the present invention.

FIG. 11 is a diagram showing an example of a current loop and direction of a magnetic field in a sheet-metal frame 13 at a point of time.

In the image display device, the polarity of the invert signal nA generated by the invert signal generating section 45 to be supplied to the source drivers 31 and 32 is set, by the invert signal initial polarity setting section 46, to be reversed to that of the invert signal nC to be supplied to the source drivers 51 and 52 and the polarity of the invert signal nB generated by the invert signal generating section 45 to be supplied to the source drivers 37 and 38 is set, by the invert signal initial polarity setting section 46, to be reversed to that of the invert signal nD generated by the invert signal generating section 45 to be supplied to the source drivers 57 and 58, and further the polarity of the invert signal nA to be supplied to the source drivers 31 an 32 is set to be reversed to the polarity of the invert signal nB to be supplied to the source drivers 37 and 38. As a result, as shown in FIG. 11, the magnetic field generated by the current loop A and the magnetic field generated by the current loop C cancel each other out, and also the magnetic field generated by the current loop B and the magnetic field generated by the current loop D cancel each other out. The magnetic field generated by the current loop A and the magnetic field generated by current loop B strengthened each other, and also the magnetic field generated by the current loop C and the magnetic field generated by the current loop D strengthen each other. In this case, a clockwise current loop is generated on the left side and a counterclockwise current loop is generated on the right side and, therefore, in the entire image display device, the magnetic fields generated by these current loop cancels each other out, which enables further lowering of the EMI emission levels when compared with the first exemplary embodiment.

Thus, exemplary embodiments of the present invention are described by referring to the drawings, however, it is apparent that the present invention is not limited to the above exemplary embodiments and may be changed and modified without departing from the scope and spirit of the invention.

Figure 12:
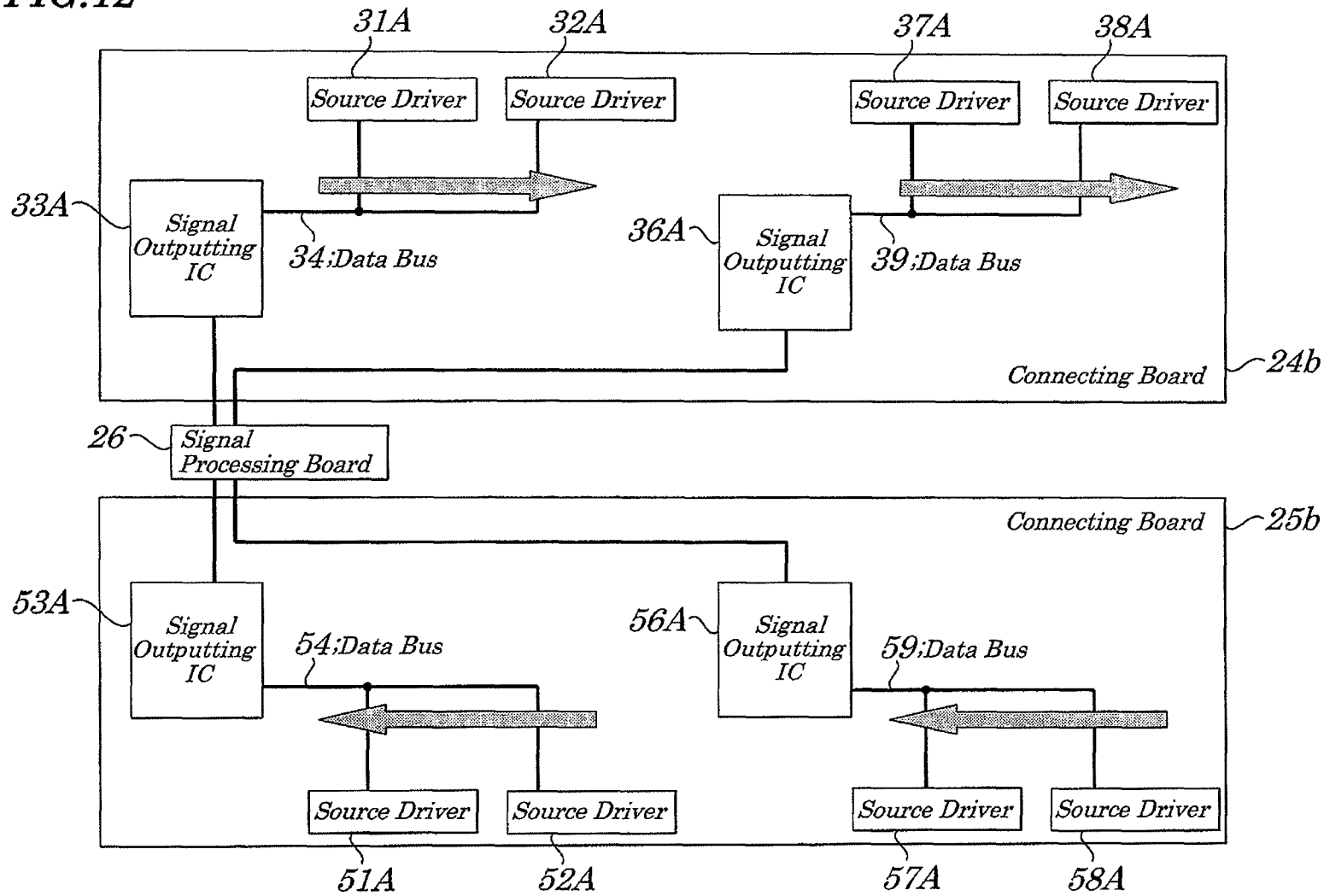
FIG. 12 is a diagram showing a modified example of the image display device of the present invention.

For example, in the image display device shown in FIG. 12, instead of the connecting boards 24*a* and 25*a* shown in FIG. 7, connecting boards 24*b* and 25*b* are implemented. On the connecting board 24*b*, on its left side, a signal outputting IC 33A, data bus 34, and source drivers 31A and 32A are mounted and, on its right, signal outputting IC 36A, data bus 39, and source drivers 37A and 38A are mounted. On the connecting board 25*b*, on its left side, a signal outputting IC 53A, data bus 54, and source drivers 51A and 52A are mounted and, on its right, signal outputting IC 56A, data bus 59, and source drivers 57A and 58A are mounted. The CMOS transmission is carried out using the signal outputting ICs 33A, 36A, 53A, and 56A. In the image display device, the direction of a current of a data signal on the data buses 34 and 39 on the connecting board 24*b* at a point of time is set, by the signal processing board 26, to be reversed to that of a current of a data signal on the data buses 54 and 59 on the connecting board 25*b*. By configuring as above, in the second exemplary embodiment, the same effect as obtained in the first exemplary embodiment can be realized.

Figure 13:
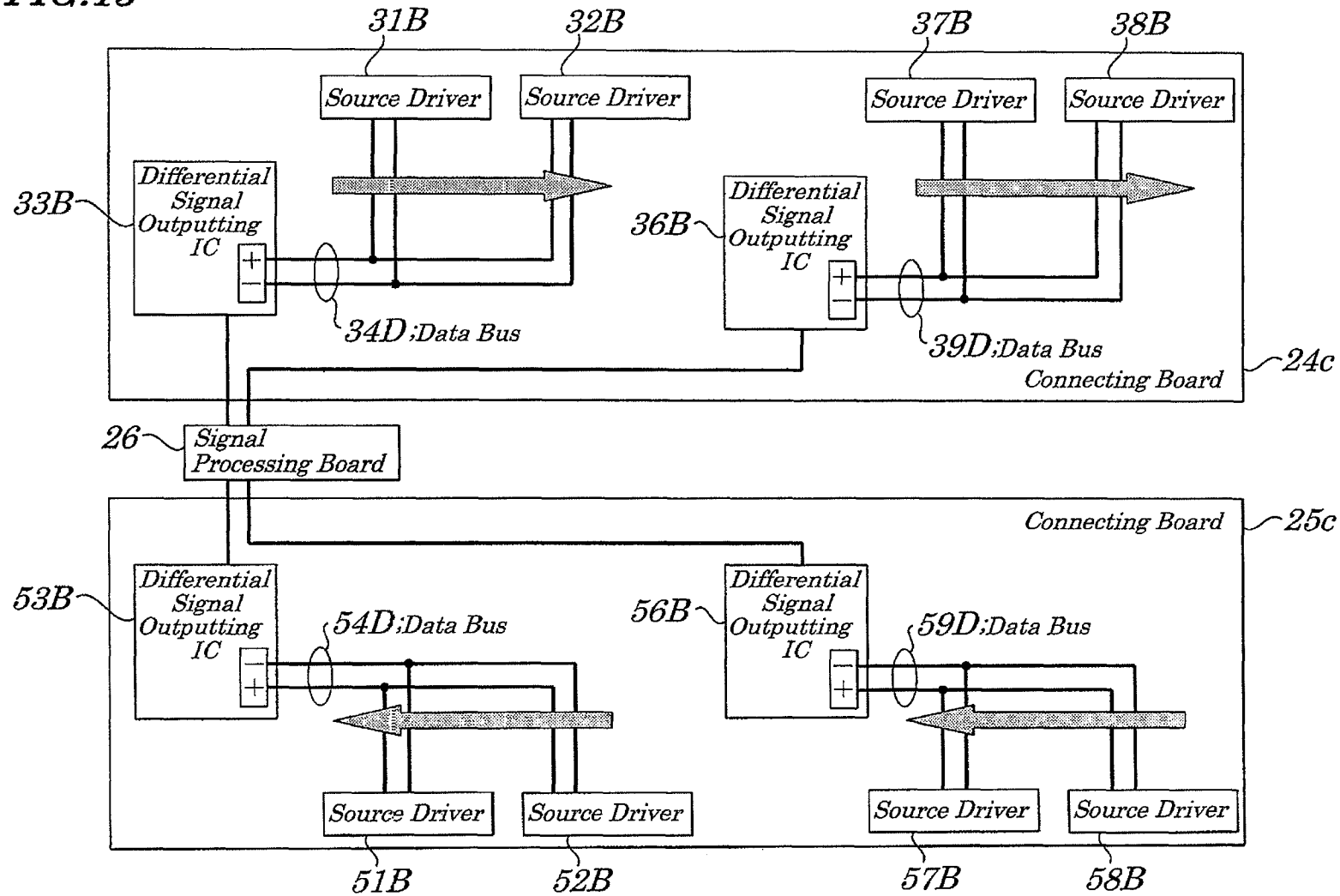
FIG. 13 is a diagram showing another modified example of the image display device of the present invention.

Moreover, in the image display device shown in FIG. 13, instead of the connecting boards 24*b* and 25*b* shown in FIG. 12, connecting boards 24*c* and 25*c* are implemented. On the connecting board 24*c*, on its left side, a differential signal outputting IC 33B, data bus 34D, and source drivers 31B and 32B are mounted and, on its right, a differential signal outputting IC 36B, data bus 391D, source drivers 37B and 38B are mounted. On the connecting board 24*b*, on its left side, a differential signal outputting IC 53B, data bus 54D, and source drivers 51A and 52B are mounted and, on its right, differential signal outputting IC 56B, data bus 591D, and source drivers 57B and 58B are mounted. The differential transmission is carried out using the differential signal outputting ICs 33B, 36B, 53B, 56B, data buses 34D, 39D, 54D, and 59D, and source drivers 31B, 32B, 37B, 38B, 51B, 52B, 57B, and 58B. In the image display device, a pair of polarities (+/−) of an output portion of the differential signal (data signal) on data buses 34D and 39D the direction of a current of a data signal on the data buses 34 and 39 on the connecting board 24*b* at a point of time is set, by the signal processing board 26, to be a pair of reversed polarities (−/+) of an output portion of the differential signal (data signal) on data buses 54D and 59D and the direction of currents flowing on the connecting board 24*c* is set to be reversed to the direction of currents flowing on the connecting board 25*c*. By configuring as above, in the second exemplary embodiment, the same effect as obtained in the first exemplary embodiment can be realized.

Figure 14:
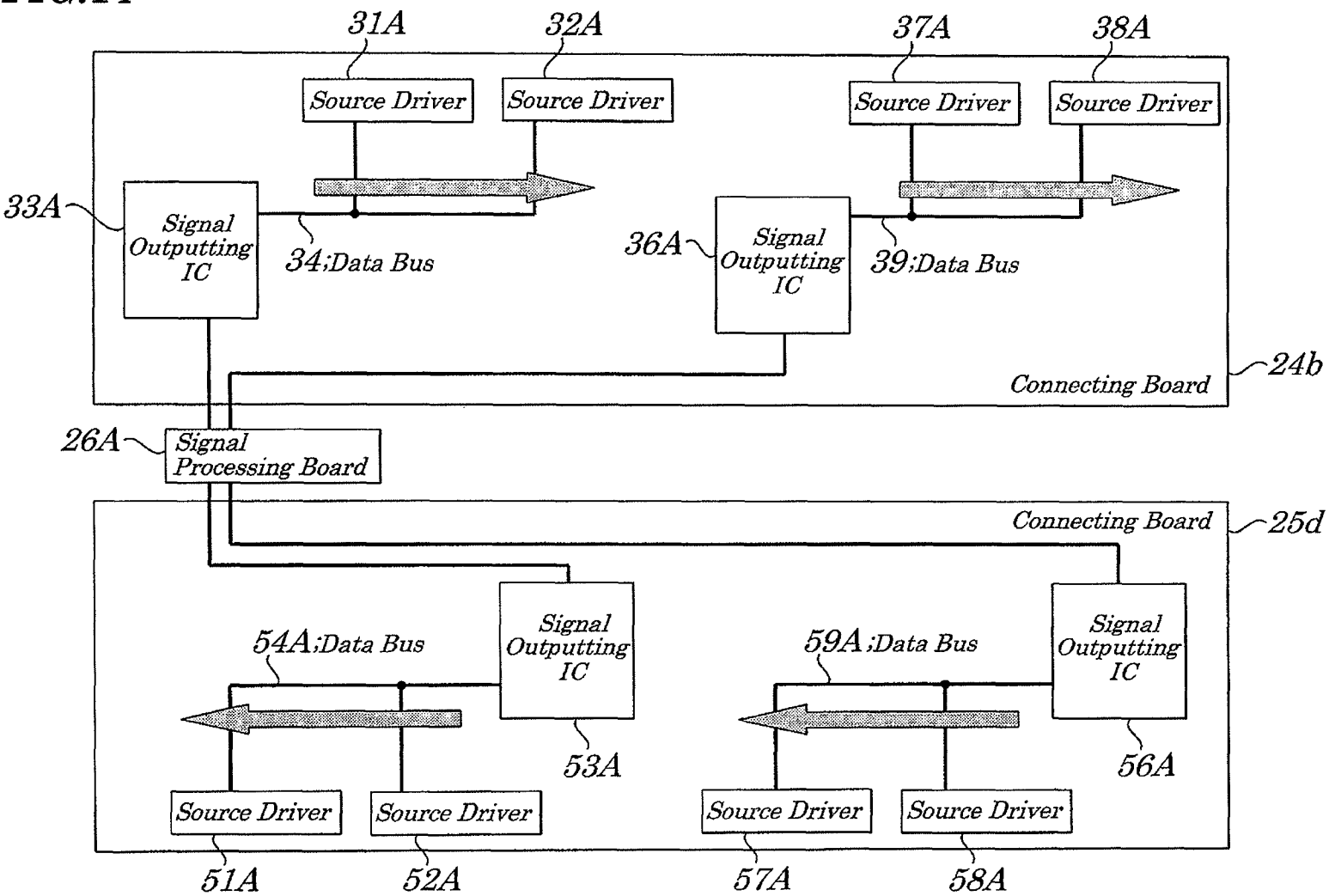
FIG. 14 is a diagram showing another modified example of the image display device of the present invention.

Moreover, in the image display device shown in FIG. 14, instead of the connecting boards 25*b* and signal processing board 26 shown in FIG. 12, connecting boards 25*d* and signal processing board 26A each having a different configuration from the connecting boards 25*b* or signal processing board 26 are implemented. On the connecting board 25*d*, instead of the data buses 54 and 59 shown in FIG. 12, data buses 54A and 59A are mounted. The direction of a current of a data signal on data buses 54A and 59A at a point of time and the direction of a current of a data signal on data buses 34 and 39 at a point of time are set to be reversed to one another. The signal processing board 26A sends out each data signal to the data buses 34, 39, 54A, and 59A in a same phase. In the image display device, the direction of a current of a data signal flowing through the data buses 34 and 39 at a point of time on the connecting board 24*b* becomes reversed to that of a current of a data signal flowing through the data buses 54A and 59A on the connecting board 25*d* at a point of time. By configuring as above, in the second exemplary embodiment, the same effect as obtained in the first exemplary embodiment can be realized. The configuration of the signal processing board 26A is configured to be simpler than that of the signal processing board 26.

Figure 15:
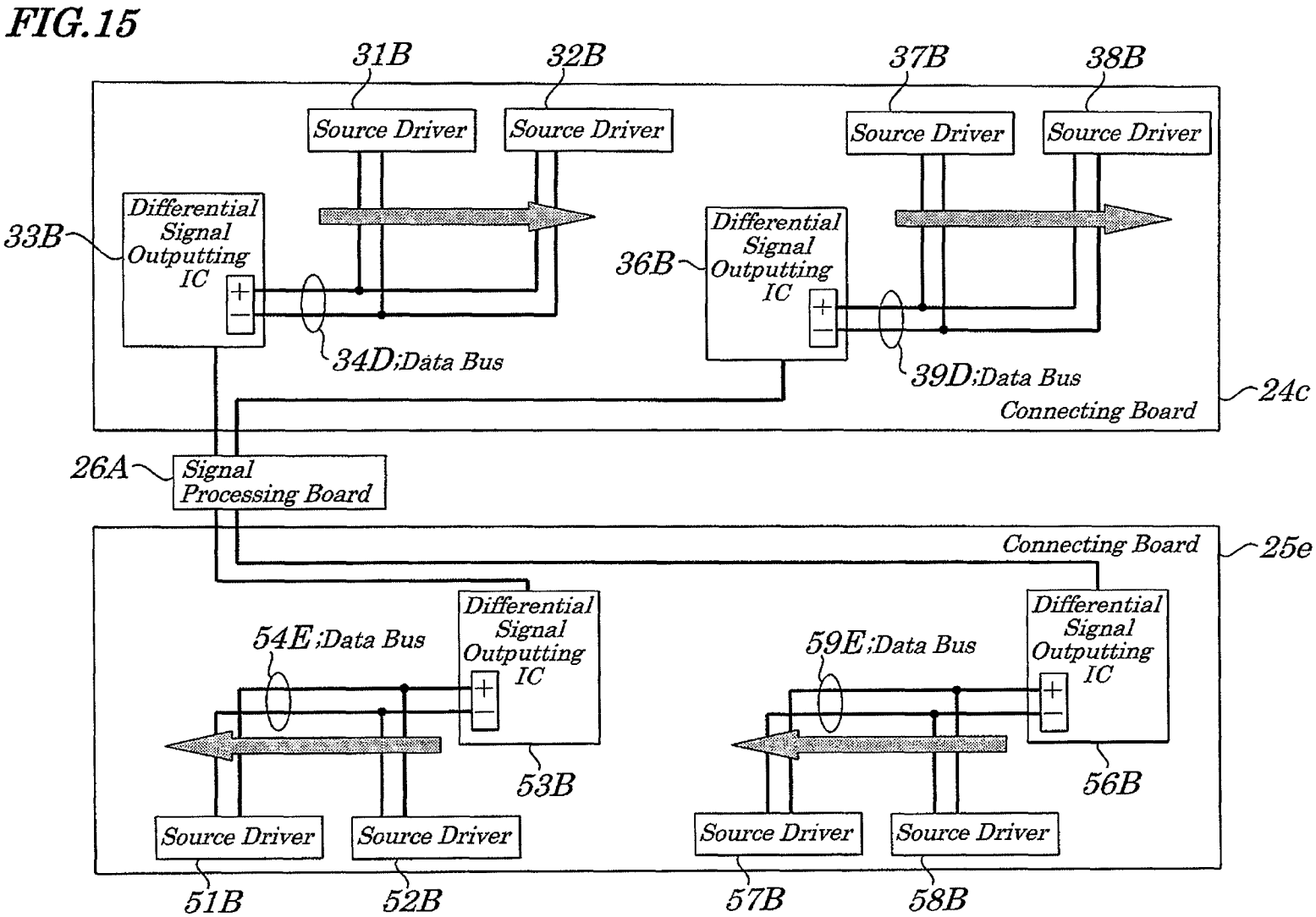
FIG. 15 is a diagram showing another modified example of the image display device of the present invention.

Moreover, in the image display device shown in FIG. 15, instead of the connecting boards 25*c* and the signal processing board 26 shown in FIG. 13, connecting boards 25*e* and the signal processing board 26A each having a different configuration from the connecting boards 25*c* or the signal processing board 26 are implemented. On the connecting board 25*e*, instead of the data buses 54D and 59D shown in FIG. 13, data buses 54E and 59E are mounted. The direction of a current of a data signal flowing through data buses 54E and 59E at a point of time and the direction of a current of a data signal flowing through data buses 34D and 39D at a point of time are reversed to one another. The signal processing board 26A sends out each data signal to the data buses 34D, 39D, 54A, and 59E in a same phase. In the image display device, the direction of a current of a data signal flowing through the data buses 34D and 39D at a point of time on the connecting board 24*c* becomes reversed to that of a current of a data signal flowing through the data buses 54E and 59E on the connecting board 25*e* at a point of time. By configuring as above, in the second exemplary embodiment, the same effect as obtained in the first exemplary embodiment can be realized. The configuration of the signal processing board 26A is configured to be simpler than that of the signal processing board 26.

Figure 16:
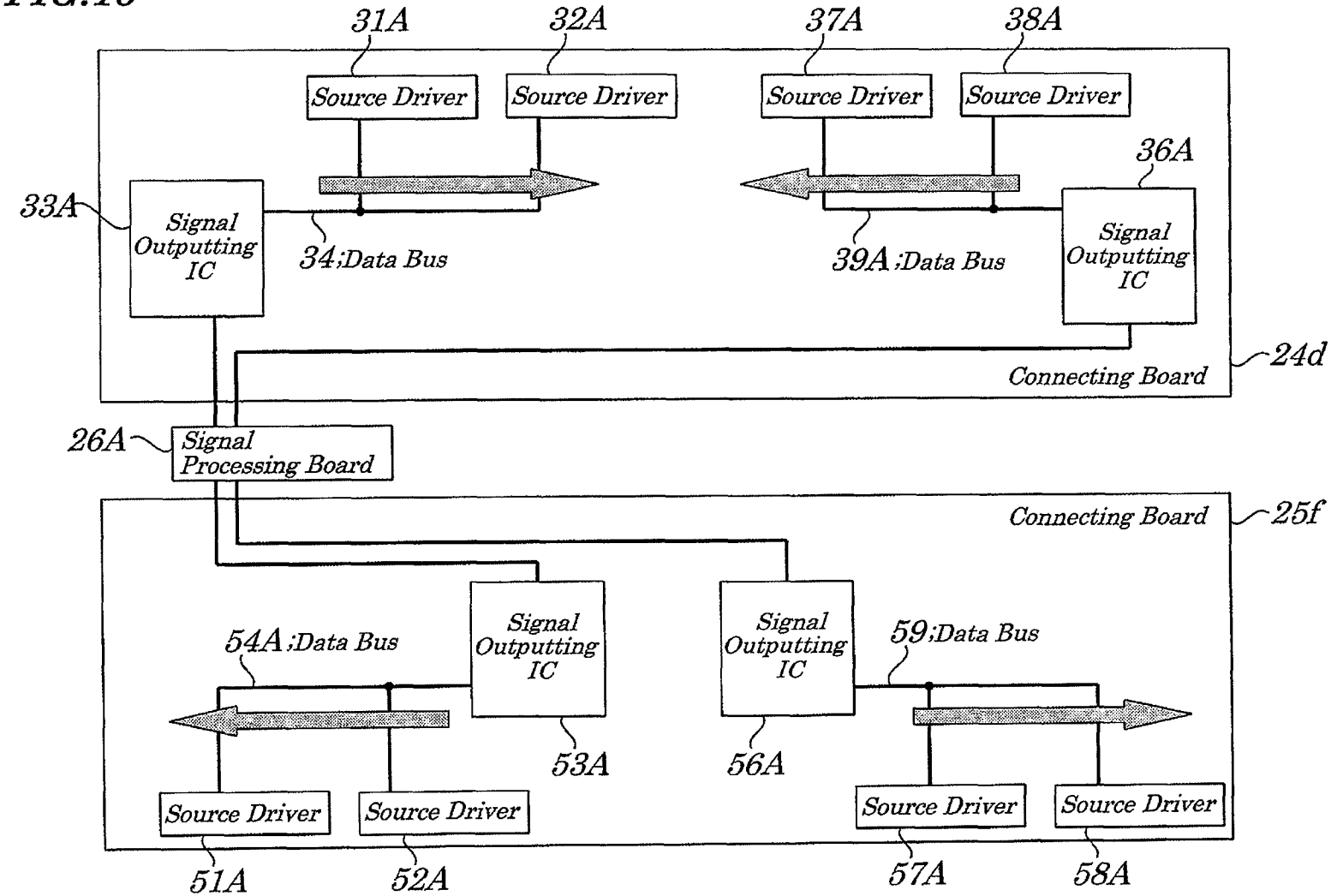
FIG. 16 is a diagram showing another modified example of the image display device of the present invention.

Moreover, in the image display device shown in FIG. 16, instead of the connecting boards 24*b* and 25*b* shown in FIG. 12, connecting boards 24*d* and 25*f* each having a different configuration are implemented. On the connecting board 24*d*, instead of the data bus 39 shown in FIG. 12, data bus 39A is mounted. On the connecting board 25*f*, instead of the data bus 54 shown in FIG. 12, data bus 54A is mounted as in the case of FIG. 4. The signal processing board 26A sends out each data signal to the data buses 34, 39A, 54A, and 59 in a same phase. In the image display device, the direction of a current of a data signal flowing through the data bus 34 at a point of time and the direction of a current of a data signal flowing through the data bus 54A are set to be reversed to each other and the direction of a current of a data signal flowing through the data bus 39A at a point of time and the direction of a current of a data signal flowing through the data bus 59 become reversed to each other and the direction of a current of a data signal flowing through the data bus 34 at a point of time and the direction of a current of a data signal flowing through the data bus 39A become reversed to each other. By configuring as above, the same effect as obtained in the second exemplary embodiment can be realized. The configuration of the signal processing board 26A is configured to be simpler than that of the signal processing board 26.

Figure 17:
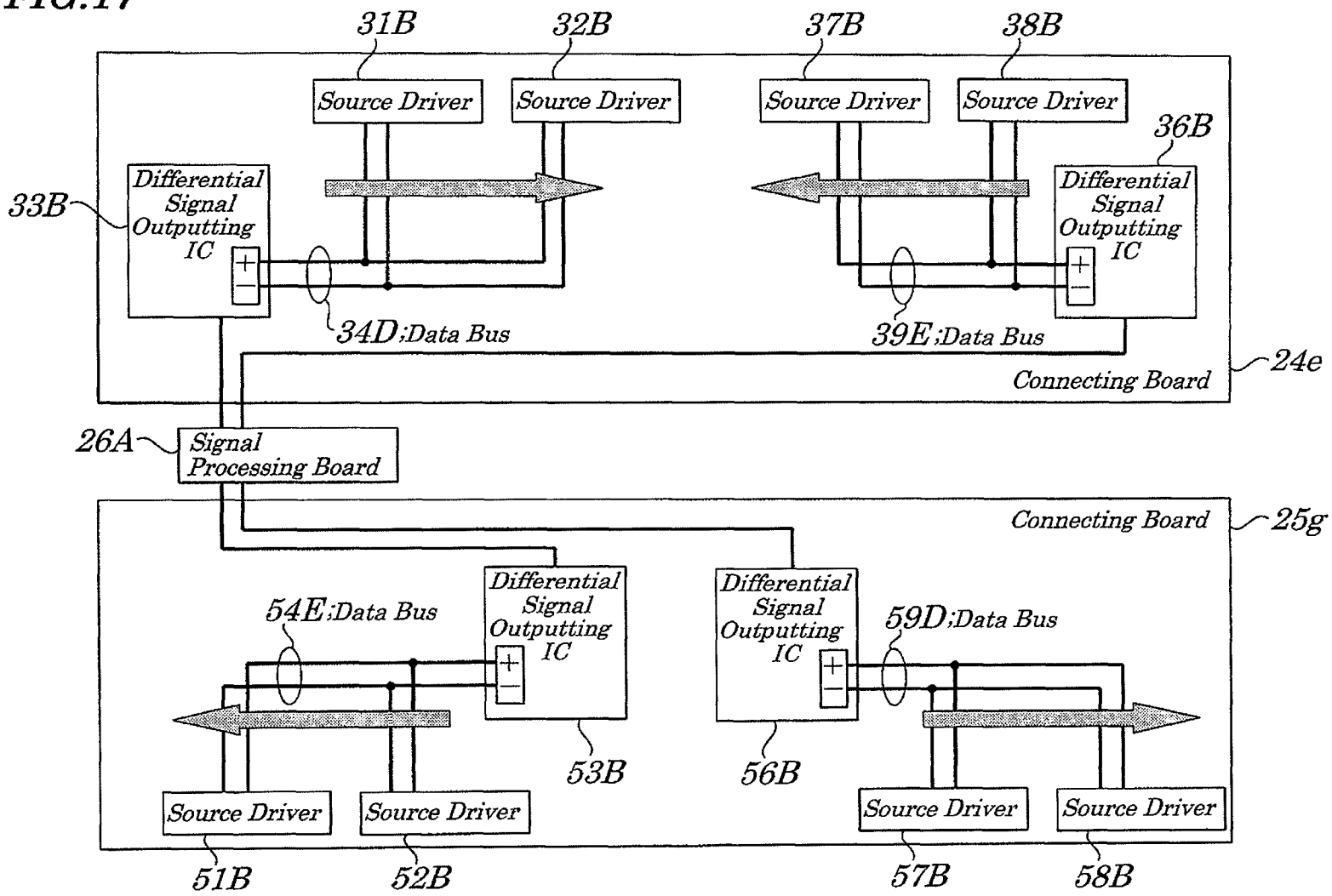
FIG. 17 is a diagram showing another modified example of the image display device of the present invention.

Moreover, in the image display device shown in FIG. 17, instead of the connecting boards 24*c*, 25*c* and the signal processing board 26 shown in FIG. 13, connecting boards 24*e* and 25*g* and the signal processing board 26A each having a different configuration from the connecting boards 24*c*, 25*c* or the signal processing board 26 are implemented. On the connecting board 24*e*, instead of the data bus 39D shown in FIG. 13, data bus 39E is mounted. On the connecting board 25*g*, instead of the data bus 54D shown in FIG. 13, data bus 54E is mounted as in the case of FIG. 15. The signal processing board 26A sends out each data signal to the data buses 34D, 39E, 54E, and 59D in a same phase. In the image display device, the direction of a current of a data signal flowing through the data bus 34D at a point of time and the direction of a current of a data signal flowing through the data bus 54E become reversed to each other and the direction of a current of a data signal flowing through the data bus 39E at a point of time and the direction of a current of a data signal flowing through the data bus 59D become reversed to each other and the direction of a current of a data signal flowing through the data bus 34D at a point of time and the direction of a current of a data signal flowing through the data bus 39E become reversed to each other. By configuring as above, the same effect as obtained in the second exemplary embodiment can be realized. The configuration of the signal processing board 26A is configured to be simpler than that of the signal processing board 26.

Figure 18:
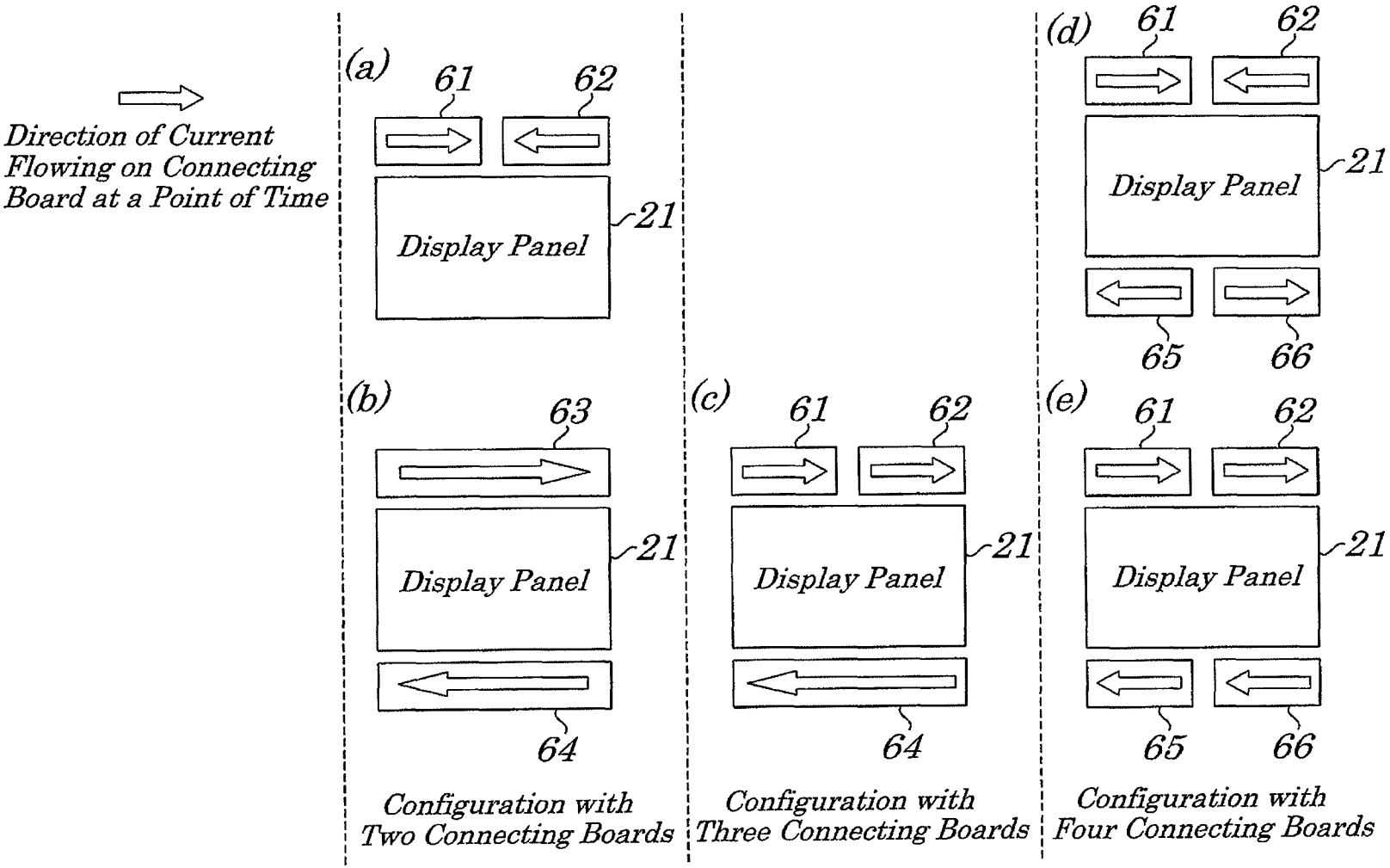
FIG. 18 is a diagram showing a modified example of a direction of a current flowing through each data bus at a point of time.
Figure 19:
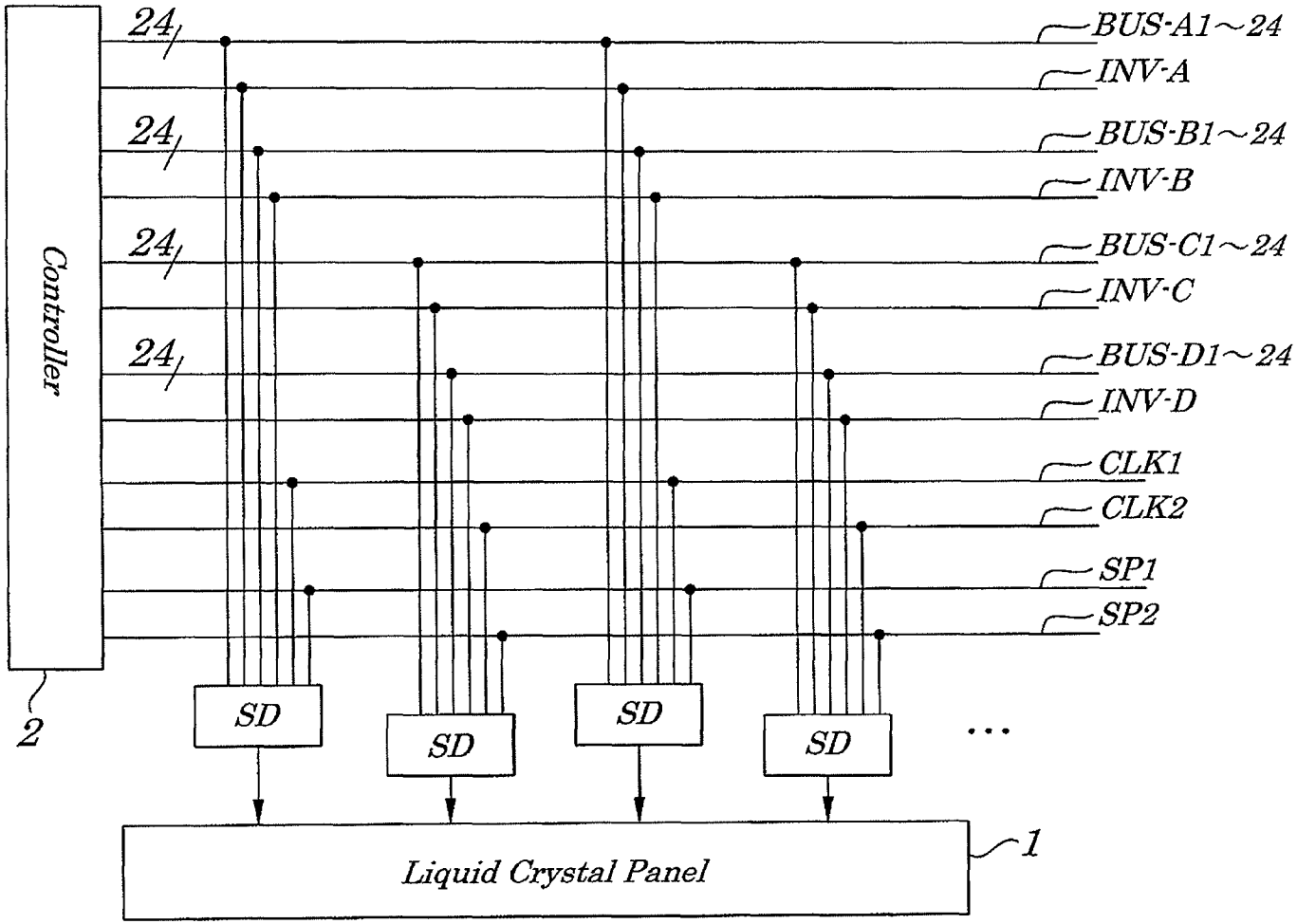
FIG. 19 (RELATED ART)
FIG. 19 is a diagram showing a configuration of a driving circuit of a liquid crystal display device in a related art.

The direction of a current flowing through each data bus at a point of time varies depending on a variety of modified configurations. For example, as shown in FIG. 18A, when the connecting board is made up of two pieces of the boards, the connecting board 61 is mounted on a left upper side of the display panel 21 and the connecting board 62 is mounted on a right upper side of the display panel 21. In the connecting board 61, as in the case of, for example, 3, unillustrated source drivers 31 and 32, CMOS interface (CMOS-TxA) 33 are implemented and further data bus 34 and notification signal transmission wiring 35 are provided. Also, in the connecting board 62, a CMOS interface (CMOS-TxB) 36, and source drivers 37 and 38 are implemented and further a data bus 39 and notification signal transmission wiring 40 are provided. In this case, the direction of a data signal current flowing through the data bus 34 at a point of time on the connecting board 61 becomes reversed to that of a data signal current flowing through the data bus 39 on the connecting board 62. By configuring as above, the same action and effect obtained in each of the above exemplary embodiments can be realized and the EMI emission level is lowered.

Further, as shown in FIG. 18B, when the connecting board is made up of two pieces of boards, the connecting board 63 is disposed on the upper side of the display panel 21 and the connecting board 64 is disposed on the lower side of the display panel 21. In the connecting board 63, as shown in FIG. 3, unillustrated source drivers 31 and 32, and CMOS interface (CMOS-TxA) 33 are implemented and data bus 34 and notification signal transmission wiring 35 are also provided and CMOS interface (CMOS-TxB) 36 and source drivers 37 and 38 are implemented and data bus 39 and notification signal transmission wiring 40 are also provided. In the connecting board 64, source drivers 51 and 52, and a CMOS interface (CMOS-TxC) 53 are implemented and a data bus 54 and notification signal transmission wiring 55 are provided and CMOS interface (CMOS-TxD) 56 and source drivers 57 and 58 are implemented and a data bus 59 and notification signal transmission wiring 50 are provided. In this case, the direction of a data signal current flowing through the data buses 34 and 39 and data buses 54 and 59 at a point of time in the connecting board 63 becomes reversed to the direction of a data signal current flowing through the data buses 54 and 59 at a point of time in the connecting board 64. By configuring as above, the same action and effect obtained in each of the above exemplary embodiments can be realized and the EMI emission level is lowered.

As shown in FIG. 18C, when the connecting board is made up of three boards, as in the case of FIG. 18A, the connecting board 61 is mounted on the left upper side of the display panel 21, the connecting board 62 is mounted on the right upper side of the display panel 21 and, as in the case of FIG. 18B, the connecting board 64 is mounted on the lower side of the display panel 21. In this case, the direction of a data signal current flowing through the data buses 34 and 39 at a point of time and the direction of a data signal current flowing through the data buses 61 and 62 at a point of time become reversed to one another. By configuring as above, the same action and effect obtained in each of the above exemplary embodiments can be realized and the EMI emission level is lowered.

As shown in FIG. 18D, when the connecting board is made up of four boards, as in the case of FIG. 18A, the connecting board 61 is mounted on the left upper side of the display panel 21, the connecting board 62 is mounted on the right upper side of the display panel 21, and the connecting board 65 is mounted on the left lower side of the display panel 21 and the connecting board 66 is mounted on the right lower side of the display panel 21. In the connecting board 65, source drivers 51 and 52, and CMOS interface (CMOS-TxC) 53 are implemented and data bus 54 and notification signal transmission wiring 55 are also provided. In the connecting board 66, source drivers 57 and 58, and CMOS interface (CMOS-TxD) 56 are implemented and data bus 59 and notification signal transmission wiring 60 are also provided. In this case, the direction of data signal currents flowing through data buses 34 and 39 and through the data buses 54 and 59 at a point of time become the same as in the case of the above second exemplary embodiment, and the same effect as obtained in the second exemplary embodiment can be realized and EMI emission level is lowered.

As shown in FIG. 18E, when the connecting board is made up of four pieces of boards, as in the case of FIG. 18D, the connecting board 61 is mounted on the left upper side of the display panel 21, connecting board 62 is mounted on the right upper side of the display panel 21, and the connecting board 65 is mounted on the left lower side and the connecting board 66 is mounted on the right lower side. In this case, the direction of data signal currents flowing through data buses 34 and 39 and through the data buses 54 and 59 at a point of time become the same as in the case of the above first exemplary embodiment, and the same effect as obtained in the second exemplary embodiment can be realized and EMI emission level is lowered.

The present invention can be applied not only to a liquid crystal display device but also to a plasma display device and generally to an image display device and particularly and effectively to a large-sized and high-definition device having complicated transmission wirings for data signal.

What is claimed is:

1. An image display device comprising:

a display panel including a plurality of display regions each having predetermined columns of data lines, predetermined rows of scanning lines, and a plurality of pixel each disposed at an intersection between each of said data lines and each of said scanning lines;

a plurality of data line driving circuits each arranged on data line terminal side margins of said display panel to write pixel data, based on a transmitted data signal, to each of said data lines in a corresponding display region, a scanning line driving circuit to output a scanning driving signal for driving each scanning line in a predetermined order based on a given scanning control signal; and a signal processing unit, based on a given video signal, to generate a data signal and to transmit the generated data signal to a corresponding one of said data line driving circuits through a corresponding data signal transmission wiring and to generate said scanning control signal and to transmit the generated scanning control signal to said scanning driving circuit, wherein said processing unit comprises:

a polarity inversion notification signal generating unit which compares, for each data line driving circuit, a gray level of said data signal with a gray level of said data signal before being transmitted to a corresponding one of said data line driving circuits, and if an amount of change in gray level is larger than a predetermined value, performs inversion of all polarities of said data signal to transmit to the corresponding one of said data line driving circuits and generates a polarity inversion notification signal showing that a polarity of said data signal has been already inverted to transmit to the corresponding one of said data line driving circuits through a corresponding notification signal transmission wiring; and a polarity inversion notification signal initial polarity setting unit which sets, for each notification signal transmission wiring, an initial polarity of said polarity inversion notification signal to be generated by said polarity inversion notification signal generating unit; and wherein each of said data line driving circuits inverts a polarity of the transmitted data signal based on said polarity inversion notification signal.

2. The image display device according to claim 1, wherein said polarity inversion notification signal generating unit, if a number of data signals whose polarities change exceeds a majority when the data signals are compared with the data signals occurred before being transmitted, inverts all polarities of said data signals.

3. The image display device according to claim 1, wherein said data line driving circuits comprises a first data line driving circuit disposed on a data line terminal side margin of an upper portion of said display panel and a second data line driving circuit disposed on a data line terminal side margin of lower portion of said display panel, and said polarity inversion notification signal initial polarity setting unit performs polarity setting so that an initial polarity of said polarity inversion notification signal, to be generated by said polarity inversion notification signal generating unit, of said first data line driving circuit disposed on said upper portion of said display panel and an initial polarity of said polarity inversion notification signal of said second data line driving circuit disposed on said lower portion of said display panel are reversed to each other.

4. The image display device according to claim 1, wherein said data line driving circuits comprises a first data line driving circuit disposed on a data line terminal side margin of left upper portion of said display panel, a second data line driving circuit disposed on a data line terminal side margin of left lower portion of said display panel, a third data line driving circuit disposed on a data line terminal side margin of right upper portion of said display panel, and a fourth data line driving circuit disposed on a data line terminal side margin of right lower portion of said display panel, and said polarity inversion notification signal initial polarity setting unit performs polarity setting so that an initial polarity of said polarity inversion notification signal, to be generated by said polarity inversion notification signal generating unit, of said first data line driving circuits disposed on said left upper portion of said display panel and an initial polarity of said polarity inversion notification signal of said second data line driving circuits disposed on said left lower portion of said display panel are reversed to each other, an initial polarity of said polarity inversion notification signal, to be generated by said polarity inversion notification signal generating unit, of said third data line driving circuits disposed on said right upper portion of said display panel and an initial polarity of said polarity inversion notification signal of said fourth data line driving circuits disposed on said right lower portion of said display panel are reversed to each other, and an initial polarity of said polarity inversion notification signal of said first data line driving circuits disposed on said left upper portion of said display panel and an initial polarity of said polarity inversion notification signal of said third data line driving circuits disposed on said right upper portion of said display panel are reversed to each other.

5. The image display device according to claim 3, further comprising:

a first board disposed on an upper side of said display panel to connect each of said data line driving circuits arranged on an upper side of said display panel to a corresponding one of said data lines, a second board disposed on a lower side of said display panel to connect each of said data line driving circuits arranged on a lower side of said display panel to a corresponding one of said data lines, and a housing made of a conductive material to which a left side terminal portion, almost central portion, and right side terminal portion of a ground pattern on said first board are electrically connected and a left side terminal portion, almost central portion, and right side terminal portion of a ground pattern on said second board are also electrically connected.

6. A transmission signal control method to be applied to an image display device comprising:

a display panel including a plurality of display regions each having predetermined columns of data lines, predetermined rows of scanning lines, and a plurality of pixel each disposed at an intersection between each of said data lines and each of said scanning lines;

a plurality of data line driving circuits each arranged on data line terminal side margins of said display panel to write pixel data, based on a transmitted data signal, to each of each of said data lines in a corresponding display region;

a scanning line driving circuit to output a scanning driving signal to drive each of said scanning lines in a predetermined order based on a given scanning control signal; and a signal processing unit, based on a given video signal, to generate a data signal and to transmit the generated data signal to a corresponding one of data line driving circuits through a corresponding data signal transmission wiring and to generate said scanning control signal and to transmit the generated scanning control signal to said scanning driving circuit, and said transmission signal control method comprising:

inverting polarities of all data signals, when a gray level of said data signal is compared with a gray level of said data signal occurred before being transmitted to each of data line driving circuits and if an amount of change in gray level is larger than a predetermined value, by using a polarity inversion notification signal generating section mounted on said signal processing unit, for each of said data line driving circuits, to transmit to a corresponding one of said data line driving circuits and generating a polarity inversion notification signal showing that polarities of all said data signals have been inverted to transmit to each of said data line driving circuits through said notification signal transmission wiring;

setting, for every notification signal transmission line, an initial polarity of said polarity inversion notification signal to be generated by said polarity, inversion notification signal generating section mounted on a polarity inversion notification signal initial polarity setting section; and inverting a polarity of said transmitted data signal based on said polarity inversion notification signal by using each of said data line driving circuits.

7. The transmission signal control method according to claim 6, wherein polarities of said data signal are inverted if the number of said data signals whose polarities changes exceeds a majority when the present data signals are compared with said data signal occurred before being transmitted, by using said polarity inversion notification signal generating section.

8. The transmission signal control method according to claim 6, wherein said data line driving circuits comprises a first data line driving circuit disposed on a data line terminal side margin of an upper portion of said display panel and a second data line driving circuit disposed on a data line terminal side margin of lower portion of said display panel, and wherein said polarity inversion notification signal initial polarity setting section performs setting so that an initial polarity of said polarity inversion notification signal to be generated by said polarity inversion notification signal generating section of said first data line driving circuit disposed on an upper portion of said display panel and an initial polarity of said polarity inversion notification signal of said second data line driving circuit disposed on said lower portion of said display panel are reversed to each other.

9. The transmission signal control method according to claim 6, wherein said data line driving circuits comprises a first data line driving circuit disposed on a data line terminal side margin of left upper portion of said display panel, a second data line driving circuit disposed on a data line terminal side margin of left lower portion of said display panel, a third data line driving circuit disposed on a data line terminal side margin of right upper portion of said display panel, and a fourth data line driving circuit disposed on a data line terminal side margin of right lower portion of said display panel, and wherein said polarity inversion notification signal initial polarity setting section performs setting so that an initial polarity of said polarity inversion notification signal of said first data line driving circuit disposed on said left upper portion of said display panel and an initial polarity of said polarity inversion notification signal of said second data line driving circuit disposed on said left lower portion of said display panel are reversed to each other, so that an initial polarity of said polarity inversion notification signal of said third data line driving circuit disposed on said right upper portion of said display panel and an initial polarity of said polarity inversion notification signal of said fourth data line driving circuit disposed on said right lower portion of said display panel are reversed to each other, and so that an initial polarity of said polarity inversion notification signal of said first data line driving circuit disposed on said left upper portion of said display panel and an initial polarity of said polarity inversion notification signal of said third data line driving circuit disposed on said right upper side of said display panel are reversed to each other.

* * * * *